US005764247A

United States Patent [19]

Asai

[11] Patent Number: 5,764,247

[45] Date of Patent: Jun. 9, 1998

[54] DRIVE METHOD FOR INK EJECTION DEVICE CAPABLE OF CANCELING RESIDUAL PRESSURE FLUCTUATIONS BY APPLYING VOLTAGE TO ELECTRODE PAIRS OF SECOND AND THIRD INK CHAMBERS SUBSEQUENT TO APPLYING VOLTAGE TO AN ELECTRODE PAIR OF A FIRST INK CHAMBER

[75] Inventor: Hiroki Asai, Aichi-ken, Japan

[73] Assignee: Brother Kogyo Kabushiki Kaisha, Nagoya, Japan

[21] Appl. No.: 338,138

[22] Filed: Nov. 9, 1994

[30] Foreign Application Priority Data

Nov. 9, 1993 [JP] Japan ..... 5-279665

[51] Int. Cl.[6] ..... B41J 29/38

[52] U.S. Cl. ..... 347/10; 347/69

[58] Field of Search ..... 347/9, 68, 10, 347/11, 12, 69, 94

[56] References Cited

U.S. PATENT DOCUMENTS

| | | | |
|---|---|---|---|
| 4,161,670 | 7/1979 | Kern | 347/69 |
| 4,245,224 | 1/1981 | Isayama et al. | 347/10 |
| 4,345,262 | 8/1982 | Shirato et al. | 347/10 |
| 4,471,363 | 9/1984 | Hanaoka | 347/10 |
| 4,498,089 | 2/1985 | Scardovi | 347/10 |
| 4,743,924 | 5/1988 | Scardovi | 347/10 |
| 4,897,667 | 1/1990 | Uchiyama et al. | 347/10 |
| 4,929,964 | 5/1990 | Sato et al. | 347/10 |
| 5,252,994 | 10/1993 | Narita et al. | 347/69 |
| 5,264,865 | 11/1993 | Shimoda et al. | 347/11 |
| 5,359,350 | 10/1994 | Nakano et al. | 347/10 |
| 5,365,643 | 11/1994 | Fujimoto | 347/68 |
| 5,426,454 | 6/1995 | Hosono et al. | 347/9 |
| 5,465,108 | 11/1995 | Fujimoto | 347/68 |

FOREIGN PATENT DOCUMENTS

| | | | |
|---|---|---|---|
| 278 590 | 8/1988 | European Pat. Off. . | |
| 596530 | 5/1994 | European Pat. Off. | 347/9 |
| A-53-12138 | 4/1978 | Japan . | |
| B2-61-59914 | 12/1986 | Japan . | |
| A-62-299343 | 12/1987 | Japan . | |
| A-63-252750 | 10/1988 | Japan . | |
| 1278358 | 11/1989 | Japan | 347/11 |
| A-2-150355 | 6/1990 | Japan . | |
| 464446 | 2/1992 | Japan | 347/11 |
| 4369542 | 12/1992 | Japan | 347/12 |
| 6198874 | 7/1994 | Japan | 347/9 |
| 2 264 086 | 8/1993 | United Kingdom . | |

*Primary Examiner*—Benjamin R. Fuller
*Assistant Examiner*—Charlene Dickens
*Attorney, Agent, or Firm*—Oliff & Berridge, PLC

[57] ABSTRACT

A drive method for an ink ejection device that cancels residual pressure fluctuations using a signal drive power source, wherein at time (b) a positive voltage V from a single power source is applied to an ink chamber 4b1 and other ink chambers 4 are connected to ground. Therefore, the volume of ink chamber 4b1 increases from a natural volume. At time (c), voltage V applied to the ink chamber 4b1 is stopped and a positive voltage V from the single power source is applied to the other ink chambers 4 so that the volume in the ink chamber 4b1 is reduced from the increased volume to an extent beyond the natural volume that causes an ink droplet to be ejected from the nozzle 12 of ink chamber 4b1. At timing (d), application of positive voltage V to the ink chambers 4c0, 4a1, 4c1, 4a2, 4b2, and 4c2 is stopped so that all the ink chambers revert to the natural volume.

13 Claims, 15 Drawing Sheets

PRIOR ART

| DURATION OF PULSE APPLIED TO INK CHAMBER 4b1 (μsec.) | EVALUATION |
|---|---|
| 4 | × |
| 8 | △ |
| 12 | ○ |
| 16 | ◎ |
| 20 | ○ |
| 24 | △ |
| 28 | × |
| 32 | × |

L/a = 16μsec.

◎:EXCELLENT RATING ○:GOOD RATING
△:NORMAL RATING ×:POOR RATING

FIG. 17

| DURATION OF PULSE APPLIED TO INK CHAMBER OTHER THAN 4b1 (μsec.) | EVALUATION |
|---|---|
| 16 | × |
| 20 | × |
| 24 | × |
| 28 | × |
| 32 | ◎ |
| 36 | ○ |
| 40 | × |
| 44 | × |
| 48 | × |

L/a = 16μsec.

◎:EXCELLENT RATING ○:GOOD RATING
△:NORMAL RATING ×:POOR RATING

| | RESIDUAL PRESSURE COEFFICIENT | | |
|---|---|---|---|
| RATIO OF VOLTAGE APPLIED TO INK CHAMBER 4b1 | - 0.3 | - 0.4 | - 0.5 |
| 10 | × | × | × |
| 20 | × | △ | △ |
| 30 | △ | ○ | ○ |
| 40 | ○ | ◎ | ◎ |
| 50 | ◎ | ◎ | ◎ |
| 60 | ◎ | ◎ | ○ |
| 70 | ○ | ○ | △ |
| 80 | △ | △ | × |
| 90 | × | × | × |

DRIVE METHOD FOR INK EJECTION DEVICE CAPABLE OF CANCELING RESIDUAL PRESSURE FLUCTUATIONS BY APPLYING VOLTAGE TO ELECTRODE PAIRS OF SECOND AND THIRD INK CHAMBERS SUBSEQUENT TO APPLYING VOLTAGE TO AN ELECTRODE PAIR OF A FIRST INK CHAMBER

BACKGROUND OF THE INVENTION

1. Field of the Invention

The present invention relates to a drive method for a shear-mode ink ejection device, which is a type of drop-on-demand ink ejection device.

2. Description of the Related Art

Non-impact type printers have largely replaced impact type printers on today's printer market and their share of the market is increasing. Ink jet printers are one type of non-impact printer. Ink jet printers are based on a simple theory and can be easily produced for printing tonal images and color images. Drop-on-demand ink jet printers eject ink only during printing so that ink is not wasted. This effective use of ink in combination with low running costs have rapidly brought drop-on-demand ink jet printers into popular use.

Several drop-on-demand ink jet printers are known in the art. Japanese Patent Application Kokoku No. SHO-53-12138 describes a Kaiser printer. Japanese Patent Application Kokoku No. SHO-61-59914 describes a thermal jet printer. However, these ink jet printers have problems which are difficult to overcome. For example, the Kaiser printer is difficult to produce in a compact size. Thermal jet printers eject ink by applying a high temperature to the ink. Therefore, only heat-resistance ink can be used in thermal jet printers.

Shear-mode ink jet printers, such as described in Japanese Patent Application Kokai No. SHO-63-252750, is a new type of ink jet printer which overcomes the above-described problems.

As shown in FIG. 1, the shear-mode ink jet printer includes a piezoelectric ceramic plate 2, a cover plate 10, a nozzle plate 14, and a substrate 41.

A plurality of grooves 3 are cut into the piezoelectric ceramic plate 2 using, for example, a diamond plate. Partition walls 6, which form the sides of each groove 3, are polarized in the direction indicated by arrow 5. The grooves 3 are formed to equal depth and in parallel with each other.

The depth of each groove 3 gradually decreases with increasing proximity to the back end 15 of the piezoelectric ceramic plate 2. Shallow grooves 7 are formed adjacent to the end 15. Metal electrodes 8 are formed to the upper half of both side surfaces of each groove 3 by sputtering or other technique. Metal electrodes 9 are formed to the floor and side surfaces of the shallow grooves 7 by sputtering or other technique. Therefore, the metal electrodes 8 formed to either side of a groove 3 are brought into electrical connection by the metal electrodes 9 formed to the floor and the side surfaces of the shallow grooves 7.

The cover plate 10 is made from a material such as a ceramic or resin material. An ink introduction port 16 and a manifold 18 are cut in the cover plate 10. The surface of the piezoelectric ceramic plate 2 with the grooves 3 formed therein is adhered by an epoxy adhesive 20 (refer to FIG. 2) to the side of the cover plate 10 with the manifold 18 formed therein. By covering the upper open end of the grooves 3 in this way, a plurality of ink chambers 4 are formed, as shown in FIG. 2, that are aligned at an equidistant pitch in the widthwise direction.

As shown in FIG. 1, the nozzle plate 14 is adhered to the end of the piezoelectric ceramic plate 2 and the cover plate 10. Nozzles 12 are formed in the nozzle plate 14 at positions thereof corresponding to the positions of the ink chambers 4. The nozzle plate 14 is formed from a plastic material such as polyester, polyimide, polyether imide, polyether ketone, polyether sulfone, polycarbonate, or cellulose acetate.

The substrate 41 is adhered by an epoxy adhesive to the surface of the piezoelectric ceramic plate 2 opposite the side with the grooves 3 formed therein. Conductive layer patterns 42 are formed in the substrate 41 at positions thereof corresponding to positions of the ink chambers 4.

Conductor wires 43 are provided for connecting the conductive layer patterns 42 to the metal electrodes 9 of the shallow grooves 7.

Next, an explanation of operation of the ink ejection device will be provided while referring to FIGS. 2 and 3. Partition wails 6 appear as shown in FIG. 2 before application of voltage. When ink is to be ejected from ink chamber **4*c*, a positive drive voltage V is applied to ink chamber 4*c*, that is, to the metal electrodes 8*d* and 8*e*, and metal electrodes 8*c* and 8*f* are connected to ground. Drive electric fields are generated in the direction indicated by arrow 13*b* in the partition wall 6*b* and in the direction indicated by arrow 13*c* in the partition wall 6*c*. Because the drive fields 13*b* and 13*c* are in directions that are perpendicular to the polarization direction 5, the partition walls 6*b* and 6*c* rapidly deform toward the interior of ink chamber 4*c* by the piezoelectric shear effect. This deformation decreases the volume of the ink chamber 4*c*, thereby increasing the pressure in the ink chamber 4*c* so as to generate a pressure wave that ejects ink from the nozzle 12 (refer to FIG. 1) that is in connection with ink channel 4*c***.

When application of the drive voltage V is stopped, the partition walls **6*b* and 6*c* return to the initial volume shown in FIG. 2. Therefore, the ink pressure in the ink chamber 4*c* gradually decreases. As a result, ink is supplied from an ink tank (not shown) to the ink chamber 4*c* by passing through the ink introduction port 16 and the manifold 18**.

A drive method for improving efficiency of ink ejection has been described wherein, as shown in FIG. 4, the partition walls are polarized in direction 71 which is the opposite direction from the polarization direction 5. By application of a positive voltage, partition walls **6*b* and 6*c* deform so as to move apart as shown in FIG. 5. By stopping application of the voltage, the partition walls 6*b* and 6*c* return to the initial shape they were in before they deformed so that ink is ejected from the ink chamber 4*c***.

The behavior of the pressure wave generated for ejecting ink from the ink chambers 4 by using this drive method will be explained in concrete terms while referring to the cross-sectional diagrams shown in FIGS. 4 and 5 of the ink ejection device.

The partition walls 6 are polarized downward as indicated by the arrow 71. In order to eject ink from the ink chamber **4*c* shown in FIG. 5, application of the voltage to the ink chamber 4*c* is controlled so that a voltage pulse is applied. (Hereinafter, application of voltage to an ink chamber will refer to application of a voltage to opposing metal electrodes in the ink chamber). In response to the rising edge of the voltage pulse, the partition walls 6*b* and 6*c* deform so as to separate apart from each other. The volume of the ink chamber 4*c* increases and the pressure in ink chamber 4*c*, which includes the vicinity of nozzle 12, decreases. This condition is maintained just for a duration of time L/a, during which time, ink is supplied from the manifold 18 (refer to FIG. 1). Duration of time L/a is the duration of time necessary for a pressure wave to propagate across the lengthwise direction of the ink chamber 4c (i.e., from the manifold 18 to the nozzle plate 14 or vice versa). Duration of time L/a is determined by the length L of the ink chamber 4 and the speed of sound a through the ink. Theories on pressure wave propagation teach that at the moment duration of time L/a elapses after the rising edge of voltage, the pressure in the ink chamber 4c inverts, thereby becoming a positive pressure. A zero voltage is applied to the ink chamber 4c that matches this timing so that the partition walls 6b and 6c revert to their initial is predeformation shape (refer to FIG. 4). The pressure generated when the partition walls 6b and 6c return to their initial shape is added to the inverted positive pressure so that a relatively high pressure is generated in the ink chamber 4c near the nozzle 12, so that ink is ejected from the nozzle 12**.

When forming image information on a recording medium using the above-described ink ejection device, adjacent ink chambers 4 can not be fired simultaneously with the above-described structure Japanese Patent Application Kokai No. HEI-2-150355, for example, describes a method for separately firing groups of even and odd numbered ink chambers 4. An improvement of this method has been described for situations with great crosstalk, that is, great interference between ink chambers 4. In the improved method, ink chambers 4 are divided into n-number of groups (wherein n is three or greater), wherein every n−1 ink chamber belongs to the same group. For example, if the ink chambers 4 shown in FIG. 5 are divided into three groups, the first group would include ink chambers 4a and 4d, the second group would include ink chambers 4b and 4e, and the third group would include ink chambers 4c and 4f. The ink chambers 4 of each group are sequentially driven on a group basis by the application of a drive voltage.

However, problems arise when ink chambers 4 are divided into three or more groups and serially driven. For example, when partition walls 6b and 6c of ink chamber 4c are deformed, as shown in FIG. 5, for ejecting ink from ink chamber 4c, because partition wall 6b is also a partition wall for ink chamber 4b and partition wall 6c is also a partition wall for ink chamber 4d, pressure waves are also generated in ink chambers 4b and 4d.

The pressure waves in ink chambers 4b, 4c, and 4d propagate through the medium (ink) in the ink chambers 4 and reflect repeatedly off the ends the ink chambers 4 until attenuating to zero. Even after ink is ejected, pressure fluctuations, which cause pressure waves, remain in the ink chambers 4. This is termed as residual pressure fluctuations.

When the succeeding ink ejection is performed at ink chamber 4d, the residual pressure fluctuations are added to pressure generated for ejecting ink so that characteristics of ink ejection (for example, speed and volume of ejected ink droplets) differ compared to when no residual pressure fluctuations are present. Residual pressure fluctuations caused by firing ink chamber 4c vary with the print pattern. For example, hardly any residual pressure fluctuations will be present in chamber 4d if ink chamber 4c is not fired before ink chamber 4d is fired. Therefore, the ink ejection characteristics of the ink chamber 4d varies with the print pattern so that stable ejection is impossible. Also, because ink is serially ejected from each group of ink chambers 4, problems occur in all ink chambers 4 of the ink ejection device, with the exception of the end ink chambers 4, which are not in any of the above-described groups so are not fired in this example.

In an attempt to decrease the residual pressure fluctuations in the ink chambers 4, Japanese Patent Application Kokai No. SHO-62-299343, for example, describes applying a cancel pulse subsequent to application of the print pulse for ejection of ink. After a set duration of time elapses after ejection of ink, a cancel pulse is applied for generating a pressure wave with a phase that is exactly the opposite of the phase of residual pressure fluctuations in the ink chamber 4. By using this method to apply a print pulse and a cancel pulse to ink chamber 4c, residual pressure fluctuations in ink chambers 4b, 4c, and 4d are simultaneously canceled out.

Fluctuations in pressure waves during ejection of ink from an ink chamber 4 and cancellation of residual pressure fluctuations will be explained here in further detail.

For ejecting ink from chamber 4c of FIG. 5, a positive ejection voltage pulse C is applied to the metal electrodes 8d and 8e of ink chamber 4c as shown in FIG. 6(*a*). The rising edge of pulse C cases partition walls 6b and 6c to deform so as separate apart from each other as shown in FIG. 5. As a result, the volume of the ink chamber 4c increases, whereupon pressure near the nozzle 12 of ink chamber 4c decreases as shown in FIG. 6(*d*). (Unless stated otherwise, references to pressure in an ink chamber 4 will refer to pressure near the nozzle 12 of the ink chamber hereinafter). This volume is maintained just for duration of time L/a. During that time, ink is supplied from the manifold 18 (refer to FIG. 1).

After duration of time L/a elapses, a zero volt voltage 0 V is applied to the ink chamber 4c as shown in FIG. 6(*a*). As a result, the partition walls 6b and 6c return to their initial condition of before deformation, which increases pressure in the ink. Pressure at this time is additive as described above so that a relatively high pressure Pc is generated in the ink chamber 4c as shown in FIG. 6(*d*). Ink is ejected from nozzle 12.

After ink is ejected, unless another voltage pulse is applied to ink chamber 4c, pressure in the ink chamber 4 continues to fluctuate in a cycle having a period of twice the duration of time L/a as shown by the solid line in FIG. 6(*d*). This is residual pressure fluctuation.

On the other hand, when this series of operations is viewed from ink chamber 4d, which is adjacent to ink chamber 4c, only one partition wall 6c deforms and in the direction opposite from when viewed from ink chamber 4c. Therefore, a pressure fluctuation appears in the vicinity of nozzle 12 of ink chamber 4d. As shown by the solid line in FIG. 6(*e*), the pressure fluctuation has half the amplitude and has a phase opposite the phase shown in FIG. 6(*d*). The solid line shown in FIG. 6(*d*) indicates residual pressure fluctuation that has been effected in the later half portion by other drive waveforms, as will be describe later. Although omitted from the diagrams, exactly the same phenomenon occurs in ink chamber 4a.

If after ink is ejected from ink chamber 4c, an ejection voltage pulse D is applied to ink chamber 4d, as shown in FIG. 6(*b*), for example, so that ink is ejected therefrom. When pulse D is applied, residual pressure fluctuations still exist in the ink chamber 4d as shown in FIG. 6(*e*). Therefore, pressure fluctuations in FIG. 6(*e*) after application of pulse D are different from pressure fluctuations from when no residual pressure fluctuations exist as indicated by the solid line in FIG. 6(*d*).

A cancel pulse K of voltage, as indicated by the broken line in FIG. 6(*a*), is applied to ink chamber 4c after duration of time L/a elapses after the rising edge of the ejection pulse C. The cancellation pulse K has a negative polarity, that is, a polarity opposite that of the ejection pulse C, and is applied for a duration of time L/a. Also, the value of the voltage pulse is set according to the residual pressure fluctuations so as to just cancel out the fluctuations. By application of the cancel pulse K, the partition walls 6b and 6c deform in the direction opposite from the direction they deformed for ejecting ink. A pressure wave with phase that is opposite the phase of the residual pressure fluctuations is applied to cancel out the residual pressure fluctuations. That is, before application of the voltage pulse D, the ink pressure in the ink chamber 4d is zero as shown by the broken lines in FIGS. 23(*d*) and 23(*e*).

Applying a print pulse D to ink chamber 4d produces in the ink chamber 4d the pressure fluctuation indicated the broken line in FIG. 6(*e*). These pressure fluctuation are the same as pressure fluctuations in the ink chamber 4c when ink is not ejected from an adjacent ink chamber directly prior to ejection of ink, as indicated by the solid line in FIG. 6(*d*).

Next, an explanation of drive circuitry for canceling residual pressure fluctuations will be provided. The output signals X, Y, and Z shown in FIG. 7 are for applying voltages V, 0, and −V/2 respectively to the metal electrodes 8 in the ink chambers 4. When the output signal X is at a HIGH level, voltage pulses for ejecting ink are generated (pulses C and D shown in FIG. 6). When the output signal Z is at a HIGH level, a voltage pulse for causing cancellation of pressure fluctuations is generated (pulse K in FIG. 6). In all other circumstances, the output signal Y is at a HIGH level so that 0 voltage is output. Capacitors 91 are formed from the partition walls 6 of each ink chamber 4 and the metal electrodes 8 formed to the partition walls 6.

The drive circuitry is formed from the three blocks surrounded by broken lines. Each block includes an ejection charge circuit 82, a discharge circuit 84, and a cancellation pressure generation circuit 86. A HIGH level input signal renders the transistor Tc ON so that a positive voltage V from the voltage source 87 is applied to the electrode E of the capacitor 91 via the resistance R12. A HIGH level input signal renders the transistor Tg ON so that electrodes E of the capacitance 91 are grounded via the resistance R12. A HIGH level input signal Z renders the transistor Ts ON so that a negative voltage −V/2 from the power source 88 is applied to the capacitor 91 via the resistance R12.

When ink is ejected in this way by a drive method including cancellation pulses, a pressure wave is propagated within the ink chamber 4 after application of the ink ejection pulse (positive voltage). After the pressure wave propagates from one end of the ink chamber 4 to the other, a cancel pulse (negative voltage) must be applied for canceling residual fluctuations. For this reason, both a positive and a negative power source are necessary. The drive circuitry becomes complicated, thus increasing costs.

SUMMARY OF THE INVENTION

It is an object of the present invention to overcome the above-described problems, and to provide a drive method for an ink ejection device capable of canceling residual pressure fluctuations using a single drive power source.

To achieve the above and other objects, an improved drive method for an ink ejection device is provided wherein the ink ejection device includes a piezoelectric element polarized in a direction. A plurality of partition walls are formed at equi-interval in the piezoelectric element. Each of the plurality of partition walls has two side surfaces opposite to each other and a top surface. A plurality of grooves are formed in the piezoelectric element wherein each of the plurality of grooves is defined by adjacent two partition walls. The ink ejection device further includes a plurality of electrode pairs. Two electrodes of each of the plurality of electrode pairs are connected together and provided interiorly of the adjacent two partition walls defining each of the plurality of grooves, respectively. A cover plate is attached to the top surfaces of the partition walls. There may be provided a nozzle plate formed with a plurality of nozzles in positions corresponding to the ink channels. An ink channel is defined by the cover plate, the adjacent two partition walls, and the nozzle plate if present. The ink channel has a length in a direction the partition walls extend toward the nozzle plate. An ink is filled with the ink channel. The ink ejection device further includes a driving device for applying a voltage to selected electrode pairs so that partition walls corresponding to the selected electrode pairs deform.

According to one aspect of the invention, step (a) is executed wherein the voltage is applied to an electrode pair of a first ink chamber for a first duration of time to deform corresponding partition walls in opposite directions, thereby ejecting an ink droplet from a corresponding nozzle. After execution of step (a), step (b) is executed wherein the voltage same as that applied to the electrode pair of the first ink chamber is applied to electrode pairs of second and third ink chambers adjacent in position to the first ink chamber for a second duration of time in directions opposite from the directions the partition walls of the first ink chamber deformed in step (a), so that residual pressure fluctuations in the first ink chamber caused by the ejection of the ink droplet are canceled.

According to another aspect of the invention, the method for driving the ink ejection device comprises the steps of (a) applying the voltage to an electrode pair of a first ink chamber so that partition walls defining the first ink chamber deform in opposite directions, thereby increasing an internal volume of the first ink chamber from a natural volume to an increased volume; (b) stopping application of the voltage to the selected electrode pair of the first ink chamber after elapse of a first predetermined duration of time from a time when the step (a) is executed so that the internal volume of the first ink chamber reverts from the increased volume to the natural volume; (c) applying the voltage to electrode pairs of second and third ink chambers adjacent to the first ink chamber, so that the partition walls of the first ink chamber deform in accessing directions opposite from the directions the partition walls thereof deformed in step (a) so that the internal volume of the first ink chamber decreases from the natural volume to a decreased volume; and (d) stopping application of the voltage to the electrode pairs of the second and third ink chambers after elapse of a second predetermined duration of time from a time when the step (c) is executed so that the internal volume of the first ink chamber reverts from the decreased volume to the natural volume.

It is preferable that the first predetermined duration of time be in a range from 0.5 L/a to 1.5 L/a, and the second predetermined duration of time is in a range from 2 L/a to 2.25 L/a, where L/a is a time required for a pressure wave imparted to the ink filled in the first chamber to propagate in the length of the ink channel of the first chamber.

More preferably, the first predetermined duration of time is determined by a time required for a pressure wave imparted to the ink filled in the first chamber to propagate in the length of the ink channel of the first chamber, and the second predetermined duration of time is twice the first predetermined duration of time.

It is also preferable that a time between an end of the first application of the voltage and a start of second application of the voltage be in a range from 0 to 0.5 L/a.

When ink is to be ejected from the first ink chamber, first, the voltage from the driving device is applied to the first ink chamber, or more accurately, to the electrode pairs on the partition walls forming the first ink chamber, so that the partition walls of the first ink chamber deform. This causes the volume of the first ink chamber to change from a natural volume to the increased volume. After the first predetermined duration of time elapses, the volume of the first ink chamber changes from the increased volume to the natural volume, and a voltage from the same power source, and with the same polarity, as the voltage applied to the first ink chamber is applied to the second and the third ink chambers, which are adjacent to the first ink chamber. This causes both partition walls of the first ink chamber to deform in the opposite direction in which they deformed previously so that the volume of the first ink chamber changes from natural volume to decreased volume. After the second predetermined duration of time elapses, the volume of the first ink chamber reverts to the natural volume.

In this way, after the voltage from the power source is applied to the first ink chamber for the first predetermined duration of time, the voltage is applied for the second predetermined duration of time to the second and third ink chambers. Thus, the volume of the first ink chamber can be increased by changing the direction in which both partition walls of the first ink chamber are deformed by a single drive power source.

In accordance with the invention, the first and second applications of the voltage are performed substantially in succession. By this, the direction in which partition walls of the first ink chamber are deformed is successively reversed.

For example, when the first predetermined duration of time is the duration of time L/a (i.e., length L of an ink chamber divided by the speed of wave a) that is required for a pressure wave to propagate across the length of the ink chamber, the pressure fluctuations in the first ink chamber can be effectively increased by successively inverting the direction in which the partition walls are deformed.

Explaining in further detail, when the voltage is applied to the first ink chamber so that both walls of the first chamber deform in opposite directions so as to separate, the volume in the first ink chamber increases so that a negative pressure is generated in the first ink chamber. When this volume is maintained for just the duration of time L/a, ink is supplied from an ink vessel and the like to the first ink chamber by the negative pressure. After the duration of time L/a elapses after application of voltage is started, the pressure in the first ink chamber inverts into a positive pressure. In concert with this timing, the second step is executed so that the voltage applied to the first ink chamber is reverted to 0. When this happens, both walls revert to their shape of prior to deforming, so that the volume of the first ink chamber is reduced. Successively, the third step is performed. When voltage is applied to the second and third ink chambers, both the partition walls of the first ink chamber deform in the direction towards each other so that the volume in the first ink chamber further decreases. The amount at which the volume of the first ink chamber decreases in the third step is about twice compared to the change in volume caused during the first step or the second step. Accordingly, this reduction in volume generates almost twice the positive pressure. This high positive pressure further increases the pressure in the first ink chamber when added to the positive pressure propagated in the ink chamber. Ink is satisfactorily ejected from the nozzle attached to the end of the first ink chamber.

In further accordance with the invention, the first step is executed wherein the volume of the first ink chamber is changed from the natural volume to the increased volume. After just a predetermined duration of time L/a, the second step is executed. The volume of the first ink chamber reverts from the increased volume to the natural volume. The third step is executed virtually successively after the second step. A voltage, with virtually the same magnitude as the voltage applied to the first ink chamber, is applied to the second and third ink chambers. The volume of the first ink chamber changes from the natural volume to the reduced volume. By this, a large positive pressure is generated in the same manner as described so that ink can be satisfactorily ejected from the first ink chamber.

After the volume in the first ink chamber changes from the natural volume to a reduced volume, and after the reduced volume is maintained, for example, for twice the duration of time L/a, application of voltage to the second and third ink chambers is stopped in the fourth step. This causes the volume of the first ink chamber to revert from the reduced volume to the natural volume. In the third step a voltage with equal magnitude to the voltage applied in the first step is applied to the second and third ink chambers to reduce the volume of the first ink chamber. At the point in time after twice the duration of time L/a elapses after the third step, positive pressure in the first ink chamber has inverted twice and attenuated twice by propagation of pressure. When the fourth step is executed, the volume of the first ink chamber reverts from the reduced volume to the natural volume so that a negative pressure is generated in the first ink chamber. However, because the positive pressure in the first ink chamber had been reduced in magnitude twice by the time the fourth step is executed, the positive pressure in the first ink chamber is virtually canceled out by the negative pressure generated during execution of the fourth step. Pressure in the second and third ink chambers is also canceled in the same manner.

In accordance with the invention, after the volume of the first ink chamber reverts to the natural volume in the second step, the voltage is applied to the second and third ink chambers in the third step so that both walls of the first ink chamber deforms in the opposite direction in which they deformed in the first step.

For example, if the predetermined duration of time is set to L/a, if the third step is executed after the predetermined duration of time elapses, if the fourth step is executed a duration of time L/a after the third step is executed, and if the voltage applied in the third step is set to an appropriate magnitude, the pressure wave generated in the first ink chamber during the first and second steps can be canceled out in the third and fourth steps.

The predetermined duration of time can be set to an appropriate value of, for example, n×L/a, wherein n is an odd number.

As is clear from the preceding explanation, deformation of opposing partition walls at both sides of the first ink chamber can be accomplished with a single drive power source. For this reason, the drive circuit is simpler that in conventional devices, and costs are decreased. Further, pressure in the ink chamber can be increased by the partition walls deforming in a small amount so that the life of the partition walls can be increased. Also, the partition walls can be made from a greater selection of materials. Furthermore, residual pressure fluctuation in the first ink chamber and in second and third ink chambers, which are adjacent to the first ink chamber, can be simply controlled and quickly reduced to almost nothing. By this, after ink is ejected from the first ink chamber, ink ejection from the first or second ink chamber can be stably and effectively performed.

BRIEF DESCRIPTION OF THE DRAWINGS

The particular features and advantages of the invention as well as other objects will become more apparent from the following description taken in connection with the accompanying drawings, in which:

FIG. 17 is a table showing results of tests wherein voltage was applied at different durations to ink chambers 4 other than the ink chamber 4*b*1 of the ink ejection device;

DETAILED DESCRIPTION OF THE PREFERRED EMBODIMENTS

Preferred embodiments of the present invention will be described with reference to the accompanying drawings.

Figure 1:
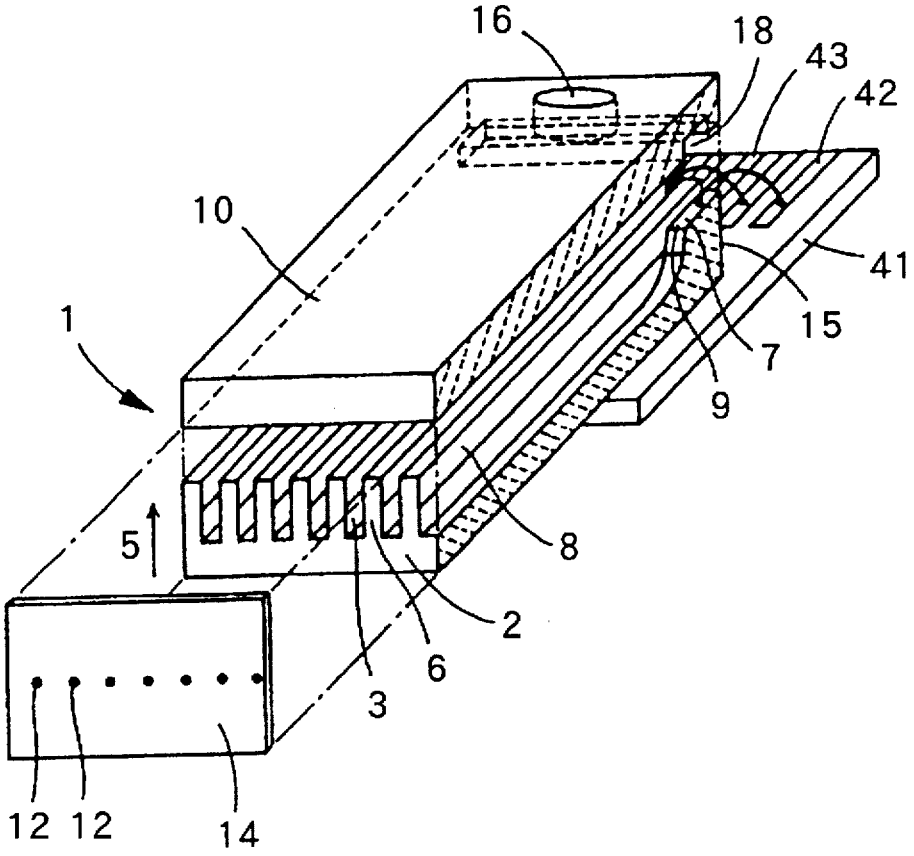
FIG. 1 PRIOR ART
FIG. 1 is a perspective diagram showing a conventional shear mode ink ejection device with a portion cross-sectionally exposed.
Figure 4:
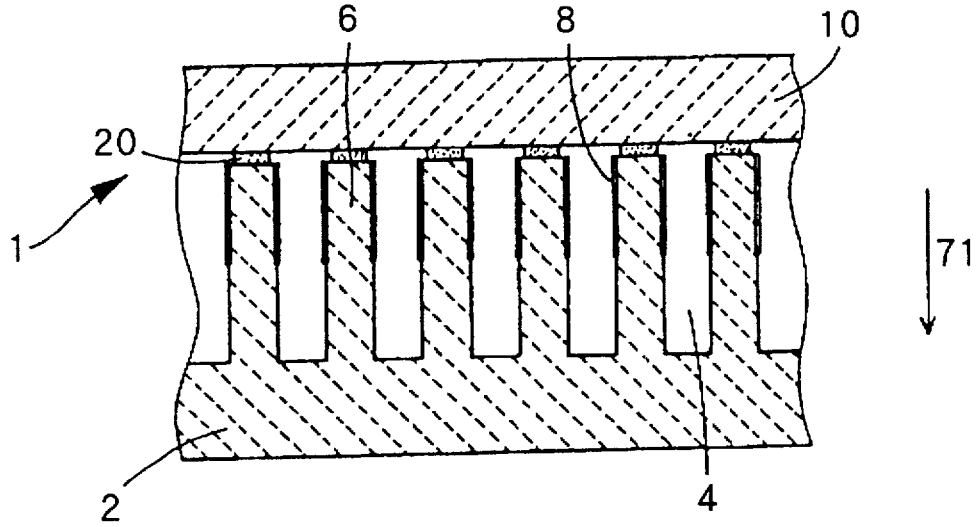
FIG. 4 PRIOR ART
FIG. 4 is a cross-sectional diagram showing a portion of the front portion of a type of shear mode ink ejection device that is different from the shear mode ink ejection device shown in FIG. 2.
Figure 5:
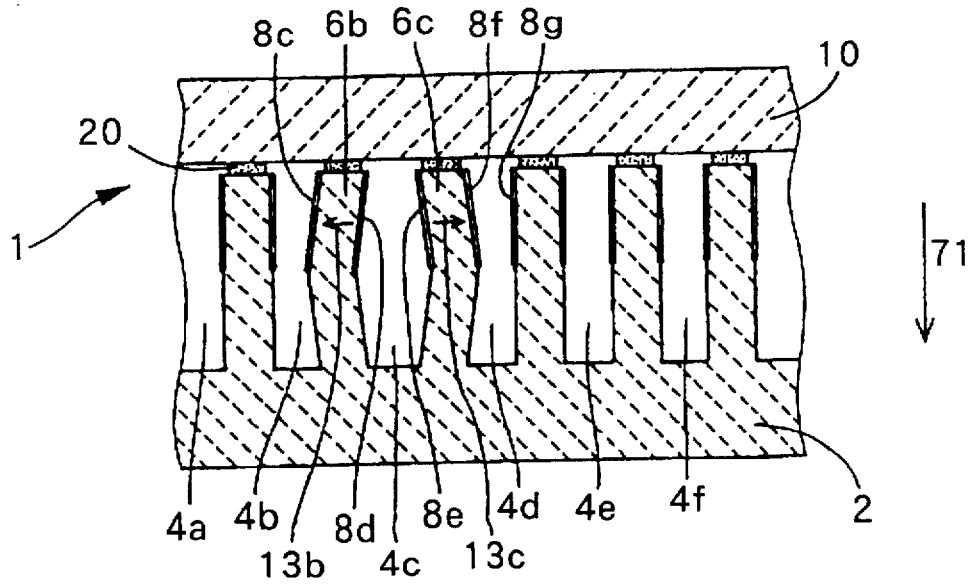
FIG. 5 PRIOR ART
FIG. 5 is a cross-sectional diagram showing an operating condition of the shear mode ink ejection device shown in FIG. 4.

An ink ejection device according to the present embodiment is the same as the conventional ink ejection device shown in FIG. 1 and includes a piezoelectric ceramic plate 2, a cover plate 10, a nozzle plate 14, and a substrate 41. A plurality of grooves 3 are formed in the piezoelectric ceramic plate 2 by partitions walls 6. The partition walls 6 are polarized in the direction indicated by the arrow 71 in FIG. 4. Both metal electrodes 8 formed to the upper half at both sides of each groove 3 are electrically connected by a metal electrode 9.

Figure 2:
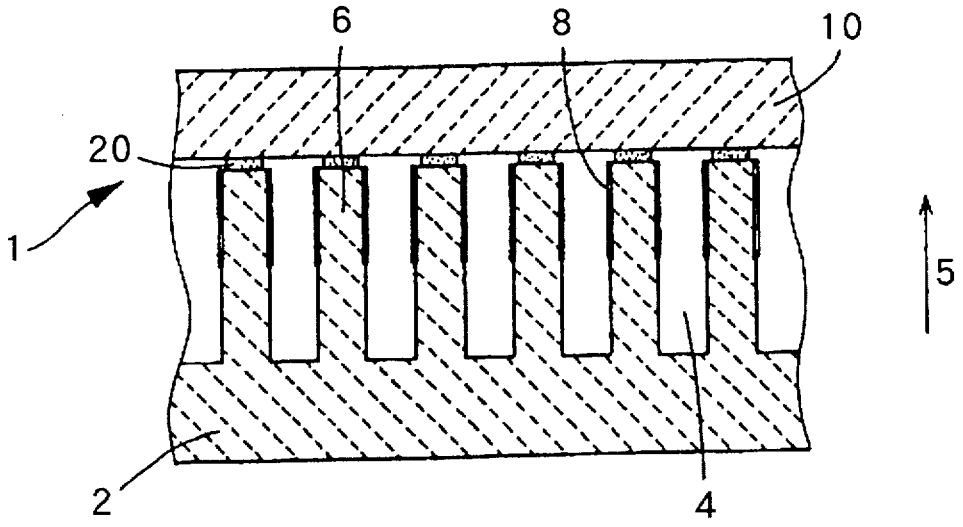
FIG. 2 PRIOR ART
FIG. 2 is a cross-sectional diagram showing a portion of the front portion of the shear mode ink ejection device.
Figure 3:
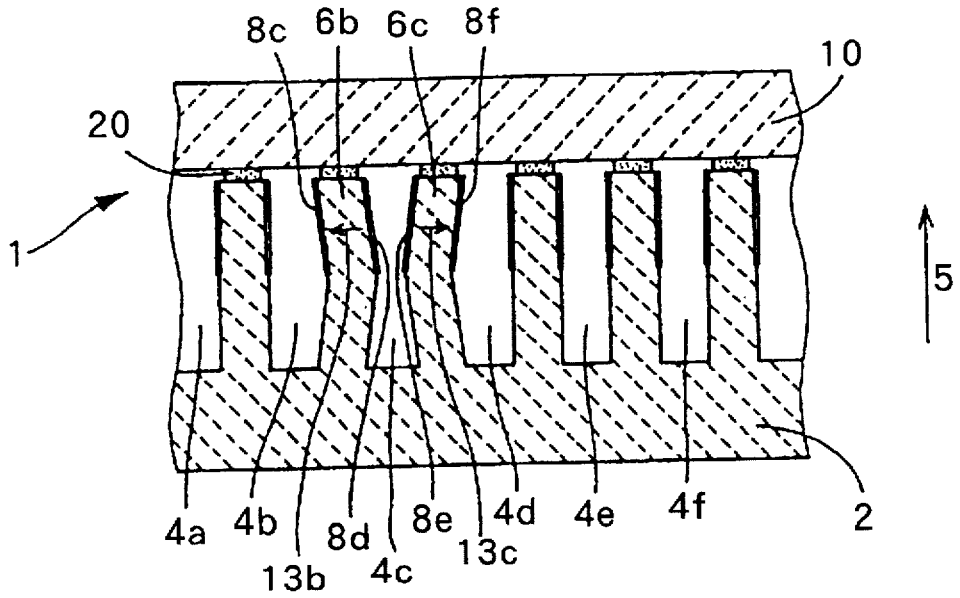
FIG. 3 PRIOR ART
FIG. 3 is a cross-sectional diagram showing an operating condition of the shear mode ink ejection device shown in FIG. 2.

The surface of the piezoelectric ceramic plate 2 with the grooves 2 formed therein is adhered using an epoxy adhesive 20 (see FIG. 2) to the surface of the cover plate 10 with the manifold 18 formed therein. In this way, a plurality of ink chambers 4 are formed.

The nozzle plate 14 is adhered to the fronts of the piezoelectric ceramic plate 2 and the cover plate 10 so that the nozzles 12 that are provided in the nozzle plate 14 are at positions that correspond to the positions of the ink chambers 4.

An example of actual dimensions of this ink ejection device are as follows. The length of the ink chamber 4 can be 7.5 mm. The diameter of the nozzles can be 40 micrometers at the ejection side and 72 micrometers at the ink chamber side. The nozzles 12 can be 100 micrometers long. Tests were performed using ink with viscosity of 5 cps and with surface tension of 30 dyn/cm. In this ink, the ratio of the speed of wave a to the length L of an ink chamber, i.e., L/a, is 16 microseconds.

Generally, in this type of ink ejection device, residual pressure near the nozzle 12 of an ink chamber 4 after ejection of ink, that is, residual pressure, has 30 to 50% the strength of pressure required for ejection of ink, and has a phase that is opposite the phase of pressure used for ejecting ink. Therefore, generally the coefficient of residual pressure is −0.3 to −0.5.

Figure 8:
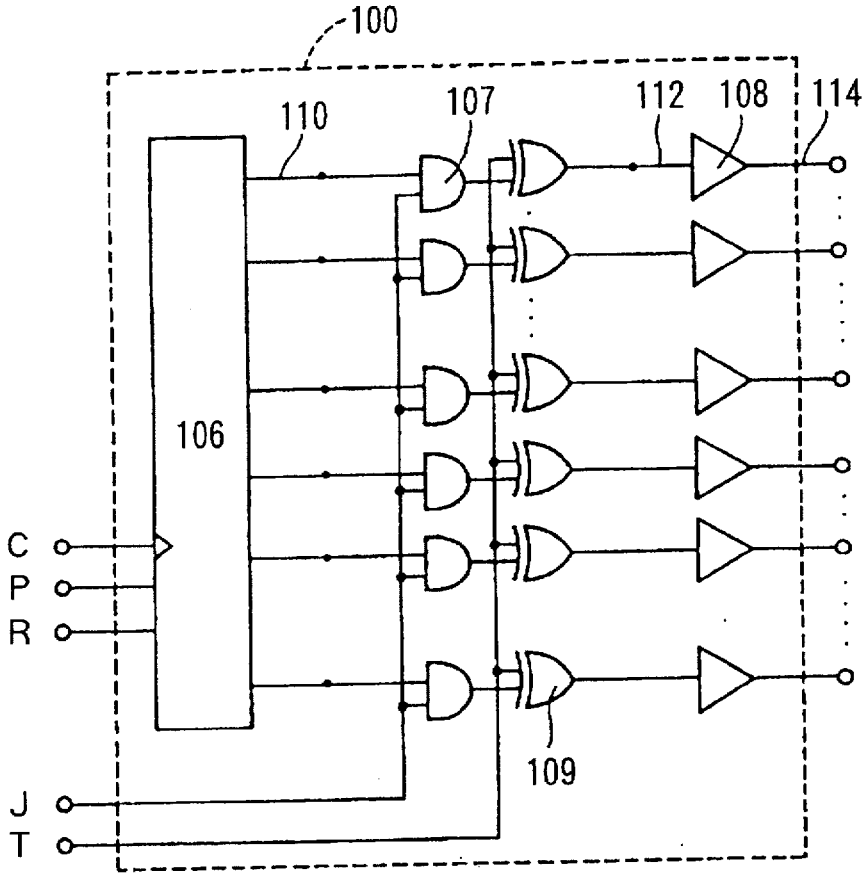
FIG. 8 is a circuit diagram showing control circuitry of an ink ejection device which can be used with embodiments of the prevent invention.

The metal electrodes 9 are electrically connected to the pattern 42 by the conductor wires 43 by well-known bonding techniques. Each pattern 42 on the substrate 41 is connected to a control circuit 100 shown in FIG. 8. An output voltage of V or 0 is applied to the ink chambers 4 as controlled based on the clock signal C, the print signal P, the latch signal R, the ejection signal J, the inversion signal T, and the like that are inputted from other circuitry.

The control circuitry 100 includes a serial-to-parallel convertor 106, and, for each pattern 42, an AND gate 107, an exclusive-OR gate 109, and a drive circuit 108. The serial-to-parallel converter 106 has a channel for each pattern 42. Therefore, the n-number of channels equals n-number of patterns. The serial-to-parallel converter 106 converts serial signals to parallel signals using general operation logic.

In accordance with the clock signal C, an n-number of serial signals P are taken in by the serial-to-parallel converter 106, whereupon these are latched by the latch signal R and outputted in parallel to the n-number of output terminals 110. The parallel print signal is rendered to a HIGH level in regards to ink chambers 4 at which printing is necessary and rendered to a LOW level in regards to all other output terminals 110. The parallel signal is transmitted to the AND gates 107.

An ejection signal J is inputted to the AND gate 107 slightly after output of the latch signal R. AND gates 107 that are inputted with a HIGH level signal from the serial-to-parallel converter 106 are rendered to output HIGH level signals by input of an ejection signal J.

Output signals from the AND gates 107 are inputted to corresponding exclusive-OR gates 109. An inversion signal R is inputted to all the exclusive-OR gates 109 at a predetermined delay after the ejection signal J. Exclusive-OR gates 109 that are inputted with identical signals are rendered to output at a LOW level. All other exclusive-OR gates 109 are rendered to output at a HIGH level.

The output signal of the exclusive-OR gate 109 is transmitted to the input terminal 112 of the corresponding drive circuits 108. When a signal output from an exclusive-OR gate 109 is at a HIGH level, a voltage V is outputted from the output terminal 114 of the drive circuit 108. When a signal output from an exclusive-OR gate 109 is at a LOW level, a zero voltage is outputted from the output terminal 114.

Figure 9:
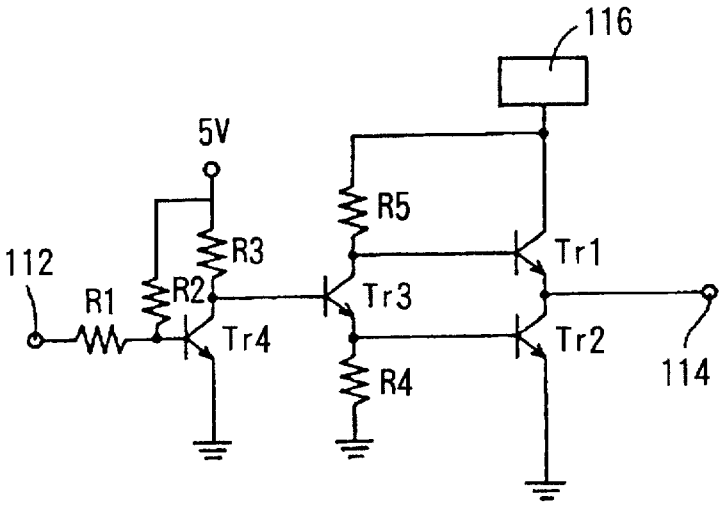
FIG. 9 is a circuit diagram showing a drive circuit of the control circuitry shown in FIG. 8.

As shown in FIG. 9, each drive circuit 108 includes an input terminal 112, an output terminal 114, a positive drive power source 116, resistors R1 through R5, and transistors Tr1 through Tr4. In each drive circuit 108, when the signal inputted to the input terminal 112 is at a HIGH level, the transistor Tr4 is rendered ON, the transistor Tr3 is rendered OFF, and the transistor Tr1, for generating the drive voltage, is rendered ON. Therefore, a voltage V from the drive power source 116 is developed at the output terminal 114. Also, the discharge transistor Tr2, whose emitter is connected to ground, is rendered OFF.

On the other hand, when the inputted signal is at a LOW level, transistor Tr4 is rendered OFF and transistor Tr3 is rendered ON so that transistor Tr1 is rendered OFF and transistor Tr2 is rendered ON. Therefore, the output terminal 114 becomes connected to ground.

Therefore, when the signal outputted to the output terminal 112 is at a HIGH level, a voltage V is developed at the output terminal 114. When the inputted signal is at a LOW level, the output terminal 114 is connected to ground so that the voltage thereat is zero.

Control of the ink ejection device by the control circuit 100 will be explained in concrete terms while referring to the time chart in FIG. 10.

Figure 11:
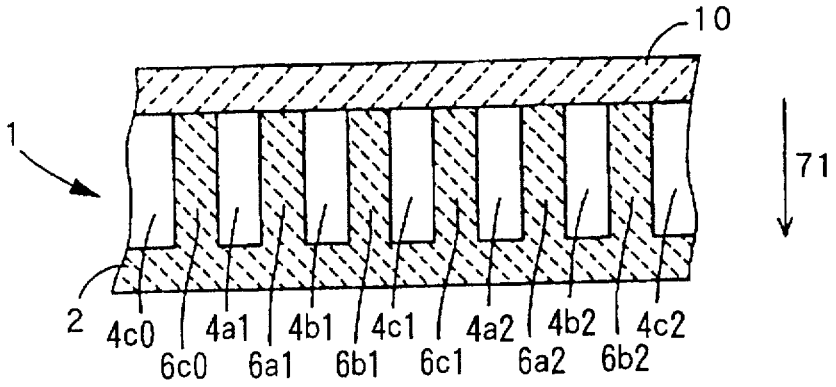
FIG. 11 is a cross-sectional diagram showing a portion of the ink ejection device.

The ink ejection device is divided into three groups and serially driven. That is, as shown in FIG. 11, ink chambers 4a1 and 4a2 belong to one group, ink chambers 4b1 and 4b2 belong to a second group, and ink chambers 4c0, 4c1, and 4c2 belong to a third group. The groups of ink chambers are driven in rotation in the order of ink chambers 4a1 and 4a2 to ink chambers 4b1 and 4b2 to ink chambers 4c0, 4c1, and 4c2.

Figure 10:
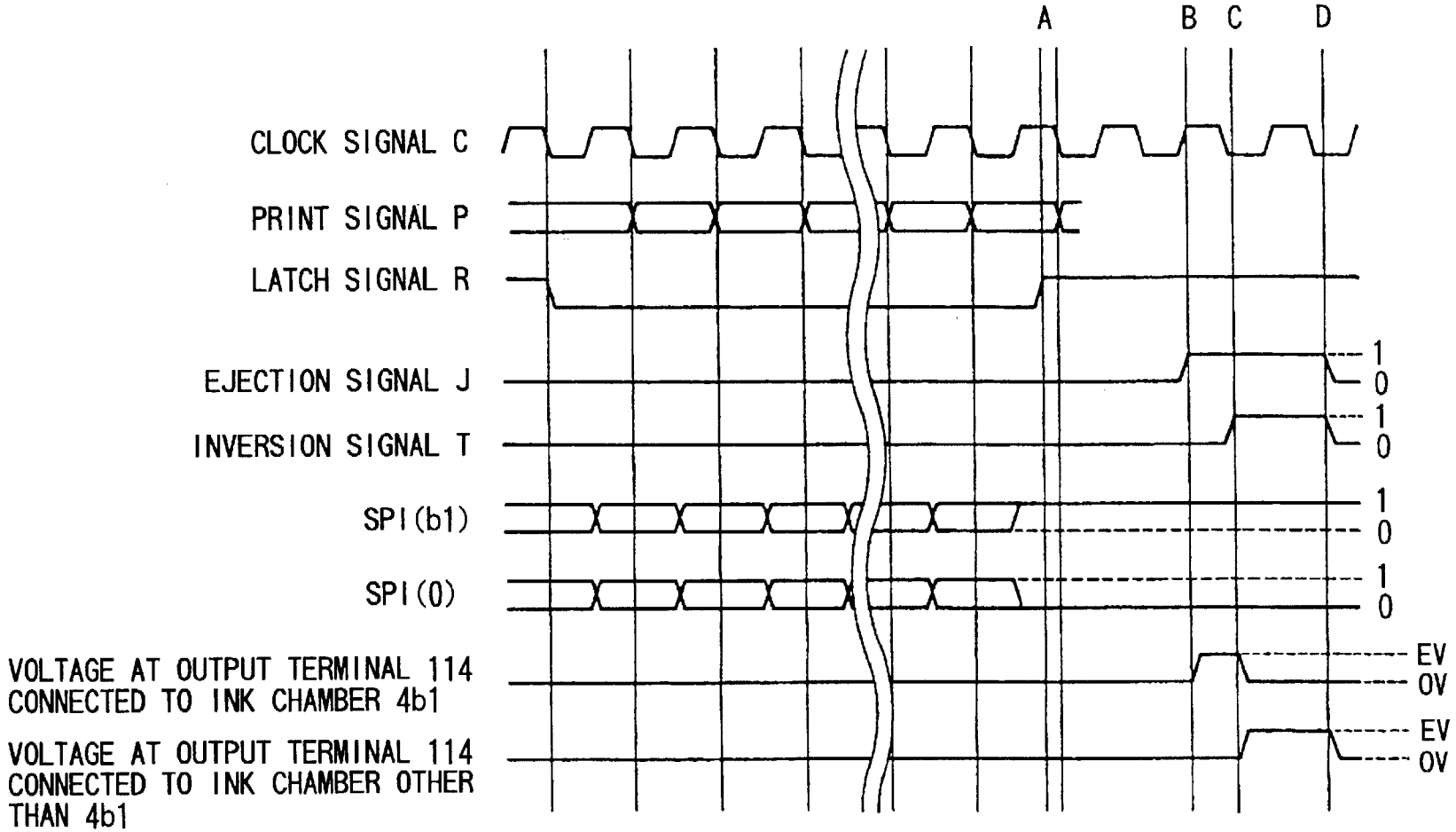
FIG. 10 is a time chart showing timing for controlling the control circuitry shown FIG. 8.

As shown in FIG. 10, data from print signal P is taken in serially into the serial-to-parallel converter 106 in synchronization with the clock signal C. A HIGH level print signal indicates that a dot is to be formed and LOW level print signal indicates that a dot is not to be formed. This is indicated by the print signal P in FIG. 10. Signals outputted from the output terminal 110 of the serial-to-parallel converter 106 are either at a HIGH or a LOW level and shift in one-channel increments as the print signal P is taken in.

At time A, when reception of a print signals with n-number bits is completed, latch signal R is inputted to the serial-to-parallel converter 106 so that bits of the signal are fixed at the output terminals 110.

An example will be provided for a situation where ink is ejected from only ink chamber 4b1 (refer to FIG. 11). The output signal SP1 (b1) that corresponds to the ink chamber 4b1 is rendered to a HIGH level. Output signals SP1 (o) for all other ink chambers 4 are rendered to a LOW level. However, even when output signals SP1 are applied to the AND gates 107, output signals from all AND gates 107 remain at a LOW level because the ejection signal J is normally at a LOW level.

However, at time B, when the ejection signal J is rendered to a HIGH level, the output signal SP2 of the AND gate 107 to which output signal SP1 (b1) is inputted is rendered to a HIGH level while the ejection signal J is at a HIGH level. The output signals SP2 (o) of other AND gates 107 remain at a LOW level.

The output signal SP2 is inputted to the exclusive-OR gates 109. Because the inversion signal T is continuously at a LOW level, only output signal SP2 (b1) of the output signal SP2 differs from the inversion signal T. For this reason, only the output signal SP3 (b1) of the exclusive-OR gate 109 into which the output signal SP2 (b1) is inputted is rendered to a HIGH level. The output signals SP3 (o) from other exclusive-OR gates 109 are rendered to a LOW level. Therefore, a drive voltage application command signal is generated only for the ink chamber 4b1.

At time C, which is duration of time L/a (for example, 16 microseconds) after application of the ejection signal J, the inversion signal T is rendered to a HIGH level. When this happens, only the output signal SP2 (b1) has the same signal as the inversion signal T. Therefore, the output signal SP3 (b1) of only the exclusive-OR gate 109 into which the output signal SP2 (b1) is inputted is rendered to a LOW level. Output signals SP3 (o) of other exclusive-OR gate 109 are rendered to a HIGH level. Because of this, a zero volt voltage from the output terminal 114 is applied to the ink chamber 4b1 and a voltage V is applied to the other ink chambers 4.

At time D, which is twice the duration of time L/a (for example, 32 microseconds) after addition of inversion signal T, both the ejection signal J and the inversion signal T are rendered to a LOW level. The output signals SP2 from all AND gates 107 are rendered to a LOW level. The output signal SP3 of the exclusive-OR gate 109 is rendered to a LOW level. Drive voltage applied to all other ink chambers 4 is rendered to a LOW level. This completes voltage supply for the first ink ejection and the device stands by for the next ink ejection. In the present embodiment, the drive frequency, which determines the interval between ejections of ink, is 5 kHz.

Figure 12:
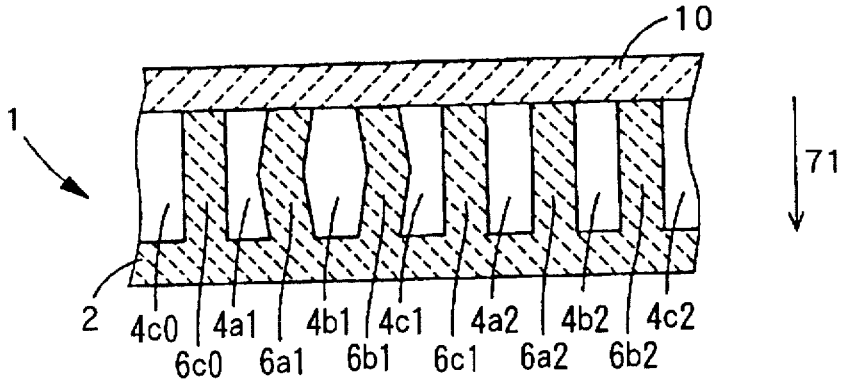
FIG. 12 is a cross-sectional diagram showing the ink ejection device shown in FIG. 11 in an operating condition.
Figure 13:
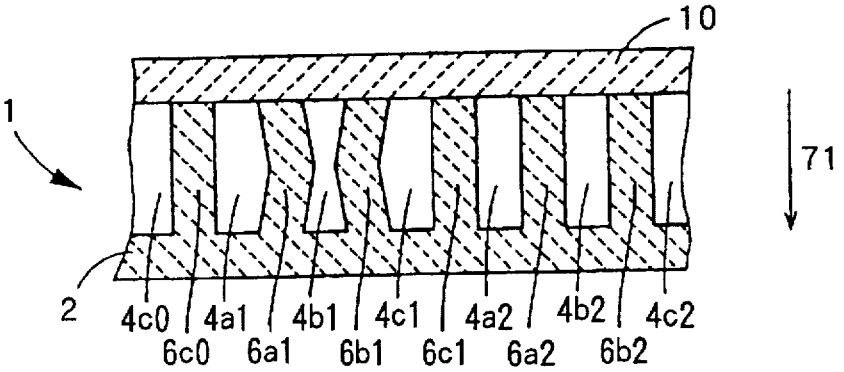
FIG. 13 is a cross-sectional diagram showing ink ejection device in another operating condition.

The ink ejection device operates as shown in FIGS. 11 through 13 to eject ink from ink chamber 4b1 according to the above-described control circuit 100.

Figure 14:
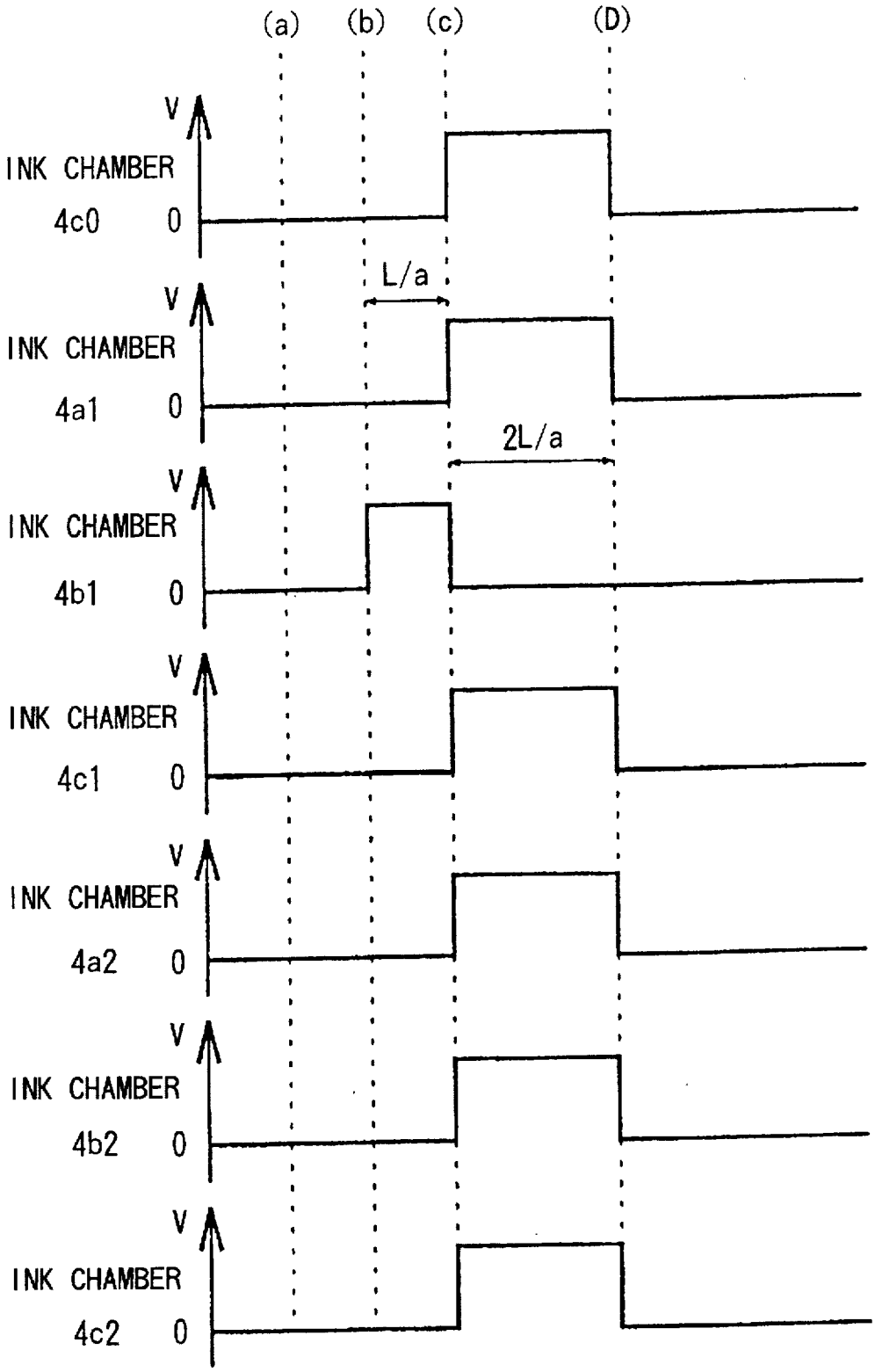
FIG. 14 is a timing chart showing a method for driving the ink ejection device.

As shown in FIG. 11, no voltage is applied to the ink chamber 4 during time (a) shown in FIG. 14. Therefore, the partition walls 6 are not deformed and the ink chambers 4 have a natural volume.

At time (b), a positive voltage V is applied to the ink chamber 4b1 and the electrodes 8 of other ink chambers 4 are connected to ground. As shown in FIG. 12, the partition walls 6a1 and 6b1 deform so as to separate from each other. The volume in the ink chamber 4b1 increases over what the volume was in the natural volume. A negative pressure is generated in the ink chamber 4b1 so that ink from an ink tank (not shown) is supplied through the ink supply port 16 and the manifold (see FIG. 1) to the ink chamber 4b1. The volume of the adjacent ink chambers 4a1 and 4c1 decreases so that a positive pressure is generated. However, this positive pressure is insufficient for ejecting ink.

As shown in FIG. 14, at time (c), which is after a duration of time L/a elapses, application of voltage V to the ink chamber 4b1 is stopped. At the same time, a positive voltage V is applied to the other ink chambers 4c0, 4a1, 4c1, 4a2, 4b2, and 4c2. As a result, the partition walls 6a1 and 6b1 overshoot the natural volume shown in FIG. 11 and deform toward the interior of ink chamber 4b1. As shown in FIG. 13, the volume of the ink chamber 4b1 changes from an increased volume to the natural volume, and overshoots the natural volume, going to a reduced volume. This change generates a positive pressure in the ink chamber 4b1. In the meantime, pressure propagation causes the negative pressure generated in the ink chamber 4b1 at time (b) to invert to a positive pressure after duration of time L/a elapses and to attenuate. The pressure generated at time (b) is added to the pressure generated at time (c) to produce a large positive pressure that ejects ink from nozzle 2 of ink chamber 4b1.

At this time, a voltage V is applied to the electrodes 8 at both sides of partitions walls 6c0, 6c1, 6a2, and 6b2, that is, to both sides of partition walls other than partition walls 6a1 and 6b1, so that electric potential at partitions walls 6c0, 6c1, 6a2, and 6b2 is zero and no electric field is generated thereat. Therefore, partition walls 6c0, 6c1, 6a2, and 6b2 do not deform. Accordingly, the volume of ink chambers 4c0, 4a2, 4b2, and 4c2 remains at the natural volume. The volume of ink chambers 4a1 and 4c1 is increased by the deformation of partition walls 6a1 and 6b1 so that a negative pressure is generated in ink chambers 4a1 and 4c1. As described above, pressure that was positive when generated at time (b), but that has by pressure propagation inverted to a negative pressure and attenuated after duration of time L/a elapses is added to the negative pressure that was generated as a result of the increase in volume of the ink chamber 4a1 at time (c).

At time (d), which is twice the duration of time L/a after time (c), the signal at input terminals 112 which correspond to the ink chambers 4c0, 4a1, 4c1, 4a2, 4b2, and 4c2 is rendered to a LOW level. The positive voltage V applied to ink chambers 4c0, 4a1, 4c1, 4a2, 4b2, and 4c2 is stopped. The partition walls 6 revert to the initial state shown in FIG. 11, and the volume of all ink chambers 4 becomes the natural volume.

The volume of ink chamber 4b1 changes from the reduced volume to the natural volume so that a negative pressure is generated. The volume of ink chambers 4a1 and 4c1 changes from the increased volume to the natural volume so that a positive pressure is generated.

By time (d), which is twice the duration of time L/a after time (c), pressure propagation has caused the pressure in ink chambers 4b1, 4a1, and 4c1 to invert twice and to reduce in size twice. That is, after duration of time L/a elapses after time (c), the pressure is inverted and reduced in magnitude. After an additional duration of time L/a elapses, the pressure will again be inverted and its magnitude will again be reduced. For this reason, at time (d), the pressure in the ink chamber 4b1 is a positive pressure that is less than the pressure at time (c) and the pressure in ink chambers 4a1 and 4c1 is less than at time (c). Accordingly, the reduced positive pressure in the ink chamber 4b1 is almost completely canceled out by the negative pressure generated when the volume of the ink chamber 4b1 goes from the decreased volume to the natural volume. The reduced negative pressure in the ink chambers 4a1 and 4c1 is almost completely canceled out by the positive pressure generated by the volume in the ink chambers 4a1 and 4c1 going from the increased volume to the natural volume.

As explained above, in the drive method of the ink ejection device according to the present embodiment, a positive voltage is applied to the ink chamber 4b1, thus causing the partition walls 6a1 and 6b1 to deform outwardly from the ink chamber 4b1. A positive voltage is applied to ink chambers 4a1 and 4c1, which are adjacent to ink chamber 4b1. This causes partition walls 6a1 and 6b1 to deform towards the interior of ink chamber 4b1. Therefore, only the positive power source 87 is needed. Control circuitry is simpler and the costs for production less expensive than the situation shown in FIG. 15, where, in order to deform partition walls 6a1 and 6b1 of ink chamber 4b1 in the same manner, a negative voltage is applied for twice the duration of time L/a successively after application of a positive voltage for the duration of time L/a.

In the present embodiment, ink is ejected at time (c) when the partition walls 6a1 and 6b1 changing from being outwardly deformed to being inwardly deformed. Partition walls 6 deform to a lesser amount than when ink is ejected from ink chamber 4b1 by deformation, either outwardly or inwardly, of only one of the partition walls 6a1 and 6b1. Therefore, generation of heat can be controlled and the life of the ink ejection device, which is determined by damage to the partition walls 6, can be increased. Only a small absolute value of voltage is necessary for deforming the partition walls 6a1 and 6b1.

Further, in the present embodiment, when twice the duration of tine L/a elapses after the rising edge of the print pulse, application of voltage to the ink chambers 4a1 and 4c1 is stopped so that the volume of the ink chambers 4b1, 4a1, and 4c1 returns to the natural state. Residual pressure that has attenuated during pressure propagation in the ink chambers 4b1, 4a1, and 4c1 is almost completely canceled out. Accordingly, ink can be satisfactorily ejected from the next group of ink chambers, which includes ink chamber 4c1. Print quality is also good.

Also, at time (c), the ink chamber 4b1, from which ink is to be ejected, is connected to ground and the ink chambers 4c0, 4a1, 4c1, 4a2, 4b2, and 4c2 are all applied with a voltage V. Therefore, the partition walls 6a1 and 6b1 deform, but the partition walls 6c0, 6c1, 6a2, and 6b2 do not deform. For this reason, the volume of ink chambers 4c0, 4a2, 4b2, and 4c2 remain at the natural volume and no pressure is generated in ink chambers 4c0, 4a2, 4b2, and 4c2. Thus, accidental ejection of droplets is prevented.

Next, an explanation of tests performed for determining the best range of the pulse width to the ink chamber 4b1 will be provided.

Figures 15, 16:
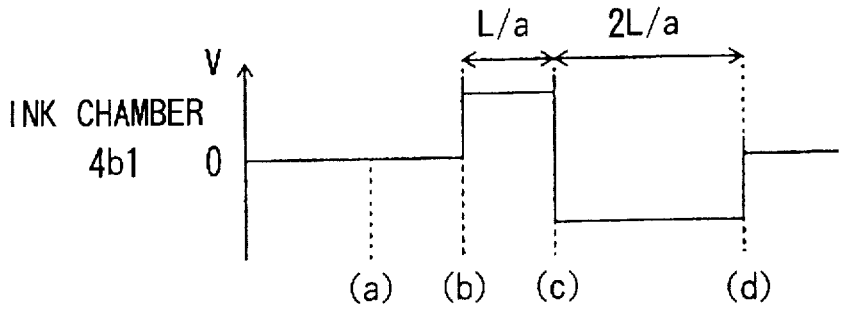
FIG. 15 is a diagram showing the apparent waveform for driving an ink chamber 4*b*1 of the ink ejection device.
FIG. 16 is a table showing results of tests wherein voltage were applied to the ink chamber 4*b*1 of the ink ejection device at different durations.

FIG. 16 indicates the results of evaluation tests in which different width pulses were applied to the ink chamber 4b1. However, at the same time application of voltage V to ink chamber 4b1 was stopped, a voltage V was applied to other ink chambers 4 for just twice the duration of time L/a.

Concentric circles represent an excellent rating, a single circle represents a good rating, a triangle represents a normal rating, and an x represents a poor rating. The evaluation tests were designed to compare the size and speed of ink droplets ejected from ink chamber 4b1 and the quality of the resultant print when ejection was and was not performed from ink chambers adjacent to the ink chamber 4a1. Print quality was judged by observations of ten people. Print was given an excellent rating when it showed uniform size and speed of ejected droplets and uniform print quality. Print was given a good rating when size of the droplets was uniform, and the speed of droplets and quality of resultant print was almost uniform. Print was given a normal rating, when size of ink droplets was almost uniform, but the speed of droplets was slightly variable. Print was given a normal rating when magnification revealed slight shifts in dot position. However, print quality was sufficient from a practical point of view. Print was given a poor rating when size of ink droplets was variable, ejection speed considerably variable, and great shifts appeared in dot position, making the printing quality unacceptable. It should be noted that if the drive frequency is reduced, durations of pulsed voltage that would otherwise produce print rated as poor will improve print quality to a normal rating. However, at such frequencies, printing speed is slow and impractical.

As shown in FIG. 16, printing by applying voltage in pulses with duration of between 9 and 24 microseconds produced print with good quality. The ink ejection device used for these tests had an L/a value of 16 microseconds, a drive frequency of 5 Khz, and a residual pressure coefficient of −0.5. However, the same results were obtained when residual pressure coefficient was −0.3 and −0.4. That is, good printing could be obtained when voltage was applied in pulses with duration of 0.5 L/a through 1.5 L/a. Other tests were performed with ink ejection devices having different L/a values, but the range for good printing remained the same.

If a pulse width of between 0.5 L/a and 1.5 L/a is applied to the ink chamber 4b1, which is the chamber from which ink is to be ejected, good printing could be obtained.

Next, the best range of the pulse width to be applied to ink chambers other than ink chamber 4b1, that is to ink chambers 4c0, 4a1, 4a1, 4c1, 4a2, 4b2, and 4c2, was determined. FIG. 17 shows evaluations of tests wherein the duration of voltage pulses applied to ink chamber 4 other than ink chamber 4b1 was changed. The standards used for the ratings shown in FIG. 17 were the same as those applied to form the results shown in FIG. 23. However, a voltage V was applied to ink chamber 4b1 for a duration of time L/a. At the same time that application of voltage V to ink chamber 4b1 was stopped, a voltage V was applied to ink chamber 4 other than ink chamber 4b1.

As shown in FIG. 17, good printing could be accomplished by application of voltage in pulses of 32 to 36 microsecond duration. An ink ejection device with L/a of 16 microseconds, drive frequency of 5 kHz, and residual pressure coefficient of −0.5 was used during these tests. However, residual pressure coefficients of −0.3 and −0.4 obtained the same results. That is, good printing could be obtained with application of voltage in pulses of 2 to 2.25 times the duration of time L/a. Other tests were performed using ink ejection devices with different L/a values without effecting the range at which good print quality could be obtained.

In this way, good print quality could be obtained when a pulse with duration of 2 to 2.25 times the duration of time L/a was applied to ink chambers 4 other than the ink chamber 4b1 from which ink was to be ejected.

Figures 18, 19:
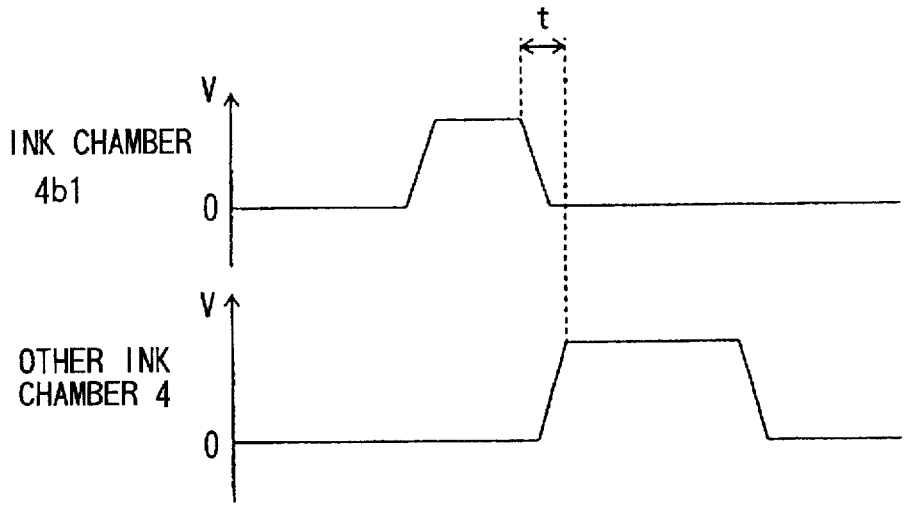
FIG. 18 is a table showing results of tests wherein ratio of voltage value of ink chambers 4 other than the ink chamber 4*b*1 of the ink ejection device was changed.
FIG. 19 is a diagram showing total time of the rising edge of voltage pulses applied to ink chamber 4*b*1 of the ink ejection device and the rising edge of voltage pulses applied to ink chambers 4 of the ink ejection device other than the ink chamber 4*b*1.

Next, the best range for the ratio between the value of voltage to be applied to the ink chamber 4b1, from which ink is to be ejected, and the value of voltage to be applied to the other ink chambers 4 was determined. FIG. 18 shows results of tests for evaluating different ratios between value of voltages applied to the ink chamber 4b1, from which ink is to be ejected, and to the other ink chambers 4c0, 4a1, 4c1, 4a2, 4b2, 4c2. The results were rated using the same standards as were applied to evaluation tests of FIG. 16. The voltage was applied to ink chamber 4b1 for a duration of time L/a and voltage was applied to other ink chambers 4 for twice the duration of time L/a.

As can be seen in FIG. 18, the range of the voltage value ratio applied to the ink chamber 4b1 wherein good print quality was obtained was 30 to 80 when the residual pressure coefficient −0.3, 20 to 80 when the residual pressure coefficient −0.4, and 20 to 70 when the residual pressure coefficient −0.5. Good print quality can be obtained by setting the magnitude of the rate of voltage value of the ink chamber 4b1, from which ink is to be ejected, and of the other ink chambers 4 within this range.

Next, the best range for total time of the rising edge of the voltage of ink chamber 4b1, from which ink is to be ejected, and of the rising edge of voltage applied to the other ink chambers 4 was determined.

To simplify the explanation provided above, the voltage applied to ink chambers 4 was treated as though it instantaneously switched from HIGH to LOW values, and vice versa. In actuality, the waveform of the voltage applied to ink chamber 4 from the output terminal 114 of the drive circuit 108 has slanted rising and lowering edges as shown in FIG. 19. The extent of the slant depends on the characteristic of the elements making up the circuit. The slant can be optionally adjusted to a set limit. It is desirable to adjust this slant, which is the duration of the rising and falling edges of the voltage, to as short a duration as possible while remaining within a range that is not shorter than the response time (to be described later) of the partition walls 6.

The total time for the rising edge and lowing edge of voltage is indicated by t in FIG. 19. The total time t change is the time required for the lowering edge of ink chamber 4b1 or the rising edge of the other ink chambers 4. However, total time t remains the same regardless of when the rising edge of the other ink chambers starts.

Figure 20:
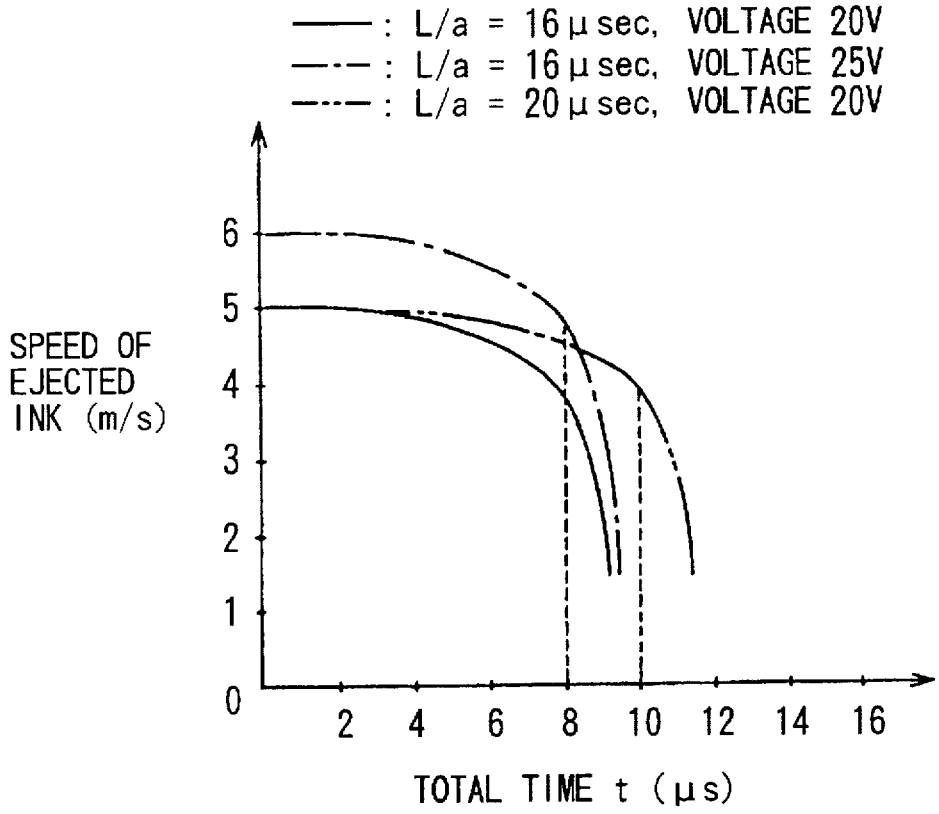
FIG. 20 is a graph showing ink ejection speed when total times shown in FIG. 19 are changed.

FIG. 20 shows the speed of ejected ink caused by different total times t of the rising edge and the lowing edge of the voltage. The solid line indicates changes in the total time t when a voltage of 20 V is applied in the ink ejection device for a duration of time L/a of 16 microseconds. The single-dash chain line indicates a voltage of 25 V. The double-dash chain line indicates when a voltage of 20 V is applied in an ink ejection device for a duration of time L/a of 20 microseconds.

As shown in FIG. 20 by the solid line, the speed of ejected ink rapidly dropped when the total time t exceeded 8 microseconds at an L/a of 16 microseconds and a voltage of 20 V. In regions where the speed of ejected ink rapidly changes, great variety in the total time t appears and the speed of ejected ink greatly changes. Quality of print suffers as a result. Little change appeared in the speed of ejected ink when the total time was within the range of 0 to 8 microseconds. Thus, good printing was obtained within this range. That is, good print quality can be obtained in the range of 0 to 0.5 L/a.

The single-dash chain line, which represents an L/a of 16 microseconds and a voltage of 25 V, ran above and parallel to the solid line, and in the same manner ejection speed dropped rapidly when the total time t exceeded 8 microseconds. That is, good print quality can be obtained in a range of 0 to 0.5 L/a. When voltage was applied at different values, lines ran parallel, but above or below, the solid line.

Accordingly, good print quality can be obtained in the range of 0 to 0.5 L/a even if the voltage value is changed.

The double-dash chain line, which represents an L/a of 20 microseconds and a voltage of 20 V, extends in the horizontal direction 1.25 times further than the solid line. When the total time t exceeded 10 microseconds, speed of ejection dropped rapidly. As a result, very little change in the ejection speed was seen when the total time t was between 0 and 10 microseconds. That is, good print quality can be obtained in the range of 0 to 0.5 L/a. When the L/a is set to another value of G, a line plotted using the results extended G/16 times further in the horizontal direction than the solid line. Accordingly, good print quality can be obtained in the range of 0 to 0.5 L/a even if the L/a is changed.

An ink ejection device with drive frequency of 5 kHz and a residual pressure coefficient of −0.5 was used in these tests. However, the same results were obtained using an ink ejection device with residual pressure coefficient of −0.3 and −0.4. The nozzles 12 had a diameter of 40 micrometers at the ink ejection side and 72 micrometers at the ink chamber 4 side. The length of nozzles 12 was 100 micrometers. However, the same results were obtained with nozzles 12 of different shapes.

The partition walls 6 have a response time which is the time from when the voltage is applied until when the partition wall 6 completes deforming. The response time of the partition walls 6 depends on the height and thickness of the partition wall 6. The partition walls 6 of the ink is ejection device used in these tests were 480 micrometers high and 85 micrometers thick, and had a response time of 2 microseconds. If voltage rises and lowers faster than the response time of the partition walls 6, the partition walls 6 do not respond, but instead heat up. At time (c) of ink ejection, partition walls 6 deform so that the ink chamber **4*b*1 changes from the increased volume to the natural volume and then to the decreased volume. Therefore, deformation of the partition wall 6 at time (s) takes at least 4 microseconds. Accordingly, ink ejection speed is rapid when the response time of the partition walls 6 is set in the range of 2 to 0.5 L/a. Additionally, good print quality can be obtained and partition walls 6 will not overheat. However, when the response time of the partition wall 6** exceeds 2.5 L/a, ink will not be ejected.

In this way, by setting the total time t assuming a response time of the partition walls 6 falls within a range of 2 to 0.5 L/a, good print quality can be obtained.

Figure 21:
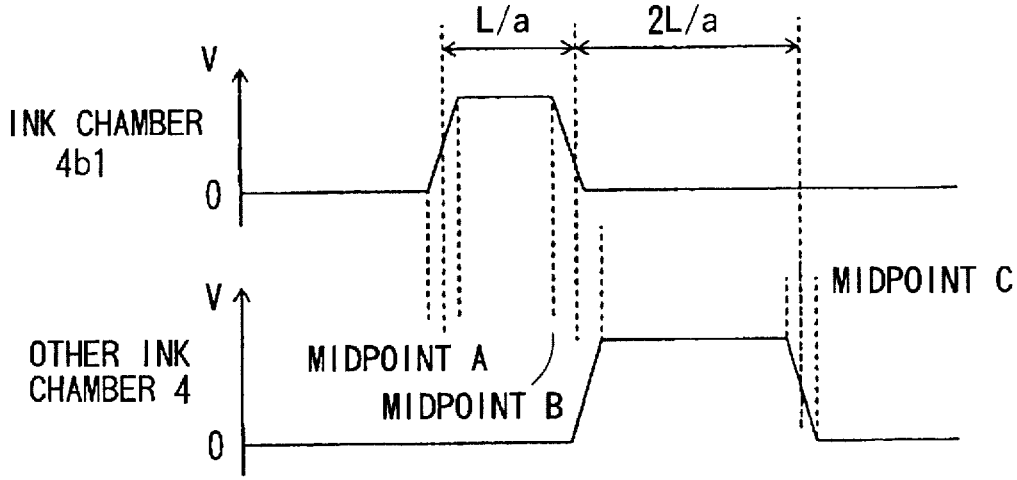
FIG. 21 is a diagram for explaining pulse width to be applied to ink chamber 4*b*1 of the ink ejection device and to other ink chambers 4 of the ink ejection device.

As shown in FIG. 21, the duration of time L/a, at which voltages are applied to the ink chamber **4*b*1, begins at the midpoint A of the rising edge of voltage applied to ink chamber 4*b*1 and ends at the midpoint B of the total time t. Twice the duration of time L/a, at which voltages are applied to the other ink chambers 4, begins at midpoint B of total time t and ends at midpoint C of the lowering edge of voltage applied to the other ink chambers 4**.

When the duration of voltage applications is set based on midpoints, ejection speed of ink is faster and residual pressure fluctuations can be satisfactorily canceled out compared to when the duration of time L/a is set as being from the starting point of the rising edge of the voltage applied to ink chamber **4*b*1 until the completion point of the lowering edge and twice the duration of time L/a is set as being from the starting point of the rising edge of the voltage applied to other ink chambers 4** until the completion point of that lowering edge.

Figure 22:
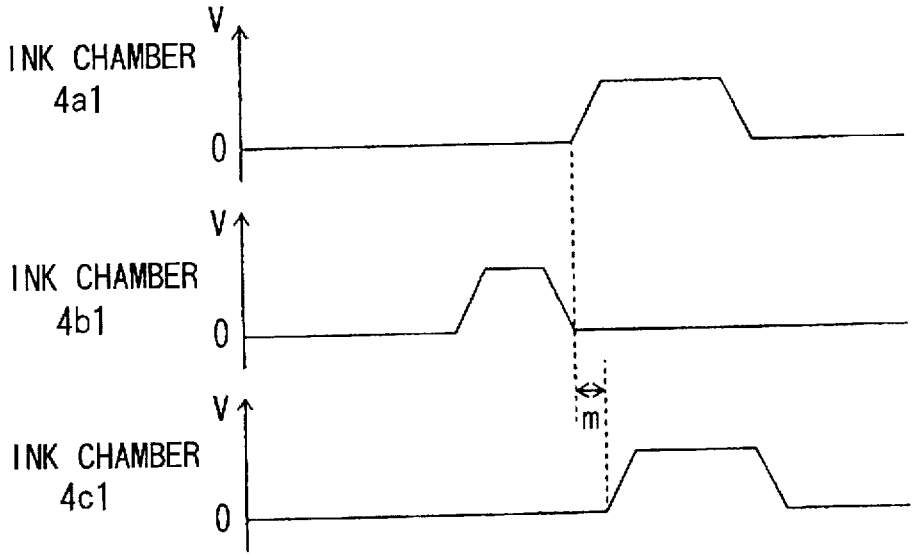
FIG. 22 is a diagram showing a lag m between start of voltage application to ink chamber 4*a*1 of the ink ejection device and to ink chambers 4*c*1 of the ink ejection device.
Figure 23:
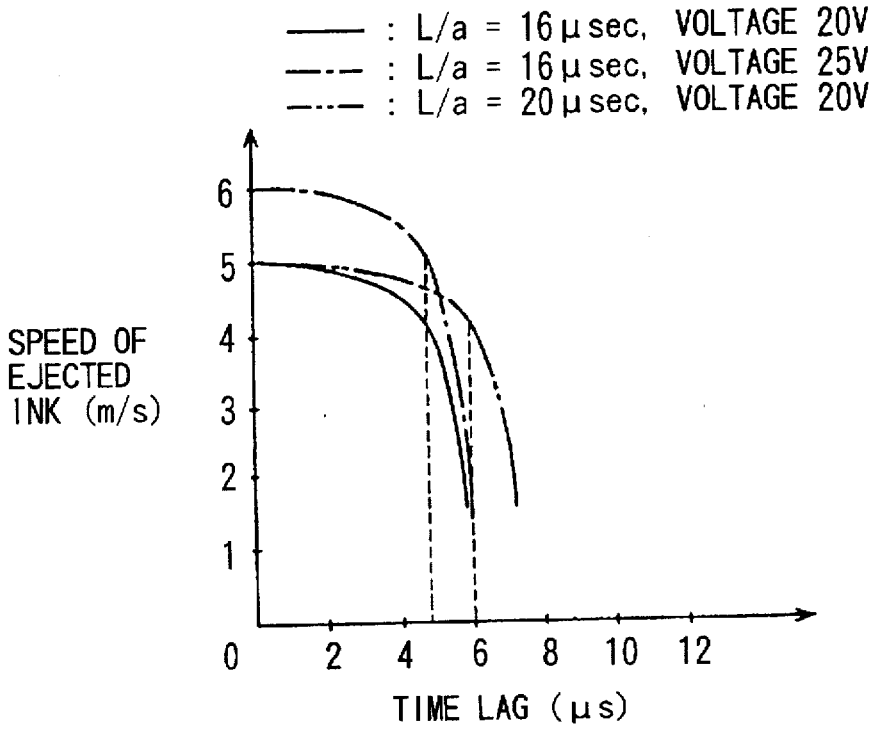
FIG. 23 is a diagram showing ink ejection speed when the voltage application start lag m of FIG. 22 is changed.

Next, the permissible range for time lag between application of voltage to the ink chamber **4*b*1, from which ink is to be ejected, and application of voltage to adjacent ink chambers 4*a*1 and 4*c*1 was determined. As can be seen in FIG. 22, lag m is the time lag between when application of a voltage to the ink chamber 4*a*1 is started and when application of a voltage to the ink chamber 4*c*1 is started. FIG. 23 shows changes in ejection speed of ink produced by changing lag m. In these tests, a voltage was applied to the ink chamber 4*a*1 after the time when the voltage of the ink chamber 4*c*1 completely lowers. Timing at which voltage was applied to the ink chamber 4*c*1 was changed. The solid line in FIG. 23** indicates results when voltage application start lag m was changed when a voltage of 20 V was applied to an ink ejection device with an L/a of 16 microseconds. The single-dash chain line indicates when a voltage of 25 V was applied in the ink ejection device. The double-dash chain line indicates when a voltage of 20 V was applied in an ink ejection device with an L/a of 20 microseconds.

When L/a is 16 microseconds and applied voltage is 20 V, as indicated by the solid line in FIG. 23, ejection speed rapidly drops when the lag m before starting application of the voltage (referred to as the voltage application start lag m hereinafter) exceeds 4.8 microseconds. When the ejection speed rapidly changes, rapid changes in ejection speed occur when there is great variety in the voltage application start lag m and print quality suffers as a result.

A voltage application start lag m in the range of 0 to 4.8 microseconds only slightly effects ejection speed so that good print quality can be obtained. That is, good print quality can be obtained in the range of 0 to 0.3 L/a.

When L/a is 16 microseconds and voltage is 25 V, as indicated by the single-dash chain line, results run parallel to, but above, the results indicated by the solid line. Ejection speed rapidly drops when the voltage application start lag m exceeds 4.8 microseconds. That is, good printing can be obtained in the range of 0 to 0.3 L/a. When the voltage was set to other values, the results remained parallel to, but either above or below, the solid line. Accordingly, good printing can be obtained when the voltage application start lag m is set within the range of 0 to 0.3 L/a even if the value of the voltage is changed.

The double-dash chain line, which represents the results of tests at a 20 microsecond L/a and a 20 V voltage, extends 1.25 times further in the horizontal direction than does the solid line. Ejection speed drops rapidly when voltage application start lag m exceeds 6 microseconds. Therefore, the ejection speed is almost unaffected when the voltage application start lag m is in the range of 0 to 6 microseconds. That is, good print quality can be obtained in the range of 0 to 0.3 L/a. When L/a was set to other values, the plotted results extended beyond the solid line G/20 times in the horizontal direction. Accordingly, good print quality can be obtained in a range of 0 to 0.3 L/a even if the L/a value is changed.

Voltage is applied to the ink chamber **4*a*1 after the start point of the lowering edge of voltage applied to the ink chamber 4*b*1. The same results were obtained even if timing of when voltage was applied to the ink chamber 4*c*1** was changed.

An ink ejection device with drive frequency of 5 kHz and with residual pressure coefficient of −0.5 was used in these tests. However, devices with residual pressure coefficient of −0.3 and −0.4 indicated the same ranges as desirable. The diameter of nozzles 12 was 40 micrometers on the ink ejection side and 72 micrometers on the ink chamber 4 side. The length of nozzles 12 was 100 micrometers. However, the same results were obtained with nozzles 12 of different shapes.

Accordingly, if the lag between when application of voltage to the ink chamber 4a1 is started and when application of voltage to the ink chamber 4c1 is started is set within 0.3 L/a, ejection speed will only be slightly effected and printing can be performed stably.

Embodiments were explained in detail above. However, the invention is not limited to these embodiments.

Figure 6:
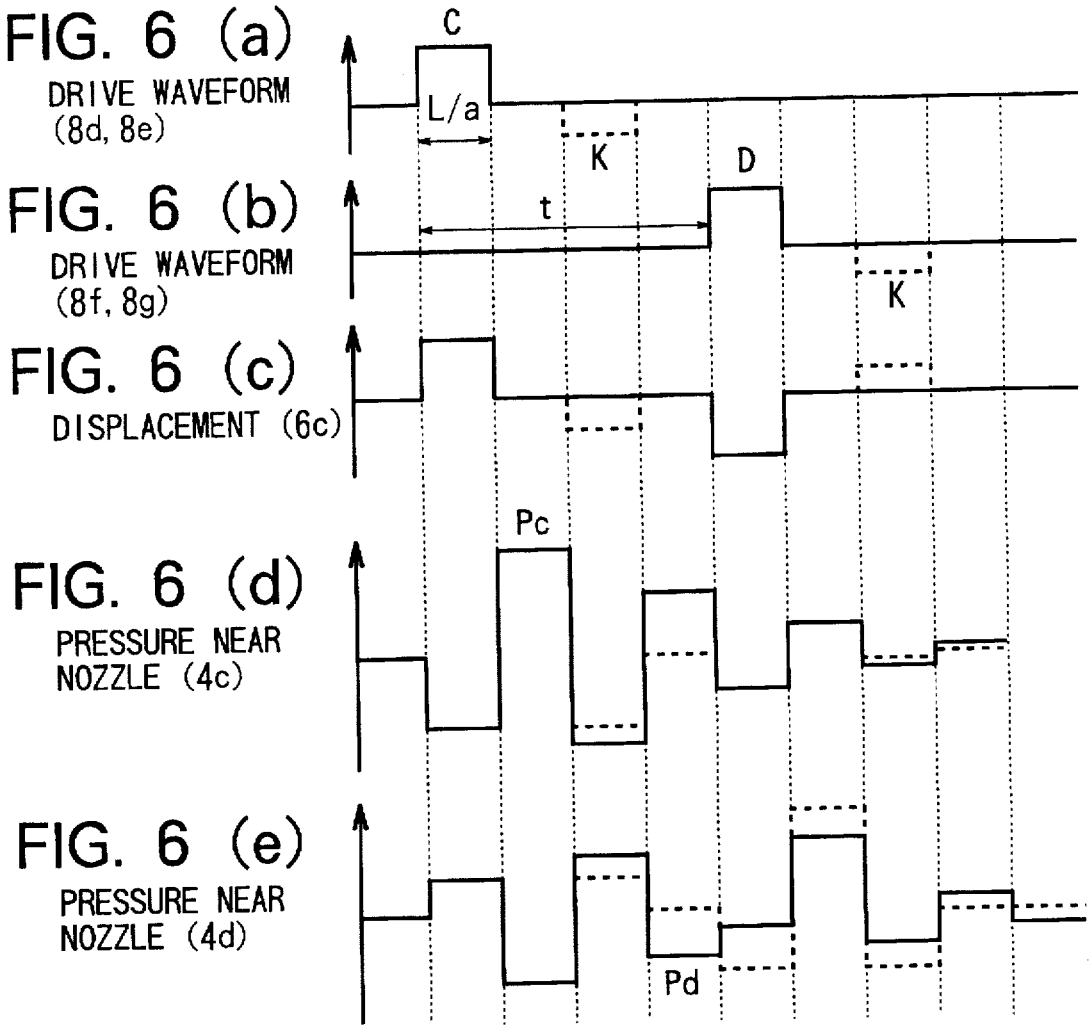
FIGS. 6(*a*), 6(*b*), 6(*c*), 6(*d*) and 6(*e*) are time charts showing a drive method for a conventional shear mode ink ejection device.
Figure 7:
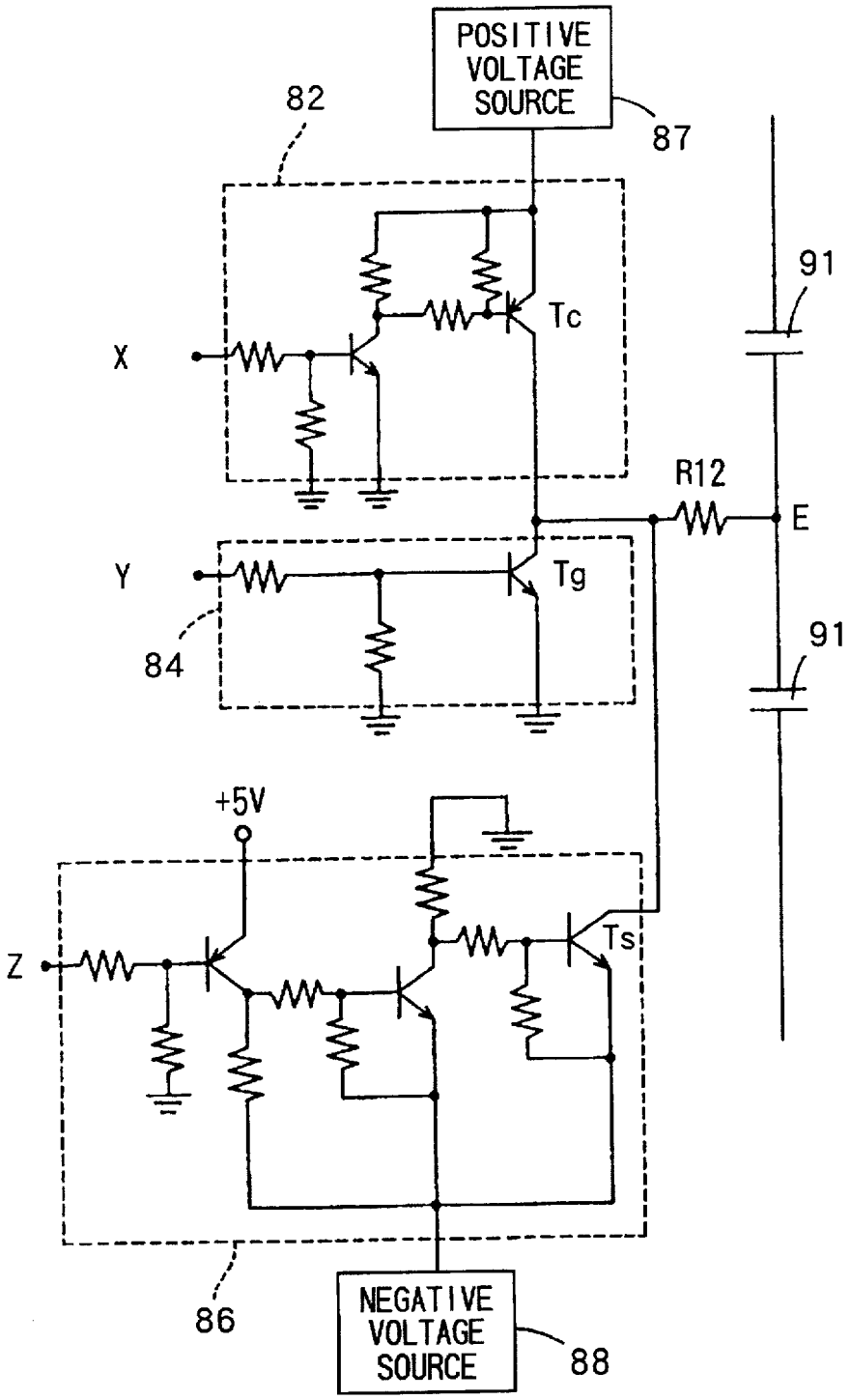
FIG. 7 PRIOR ART
FIG. 7 is a circuit diagram showing drive circuit for a conventional shear mode ink ejection device.

For example, it is possible with the present invention to obtain the same effects as with the conventional technology shown in FIG. 6. After application of a positive ejection pulse to the electrodes 8 in an ink chamber 4, from which ink is to be ejected, a positive cancel pulse is applied to the electrodes 8 of adjacent ink chambers 4 after elapse of a duration of time L/a.

Also, a positive power source 87 was used in the above-described embodiments. However, a negative power source could be used if the piezoelectric material is polarized in the direction indicated by the arrow 5 in FIG. 1.

Figure 24:
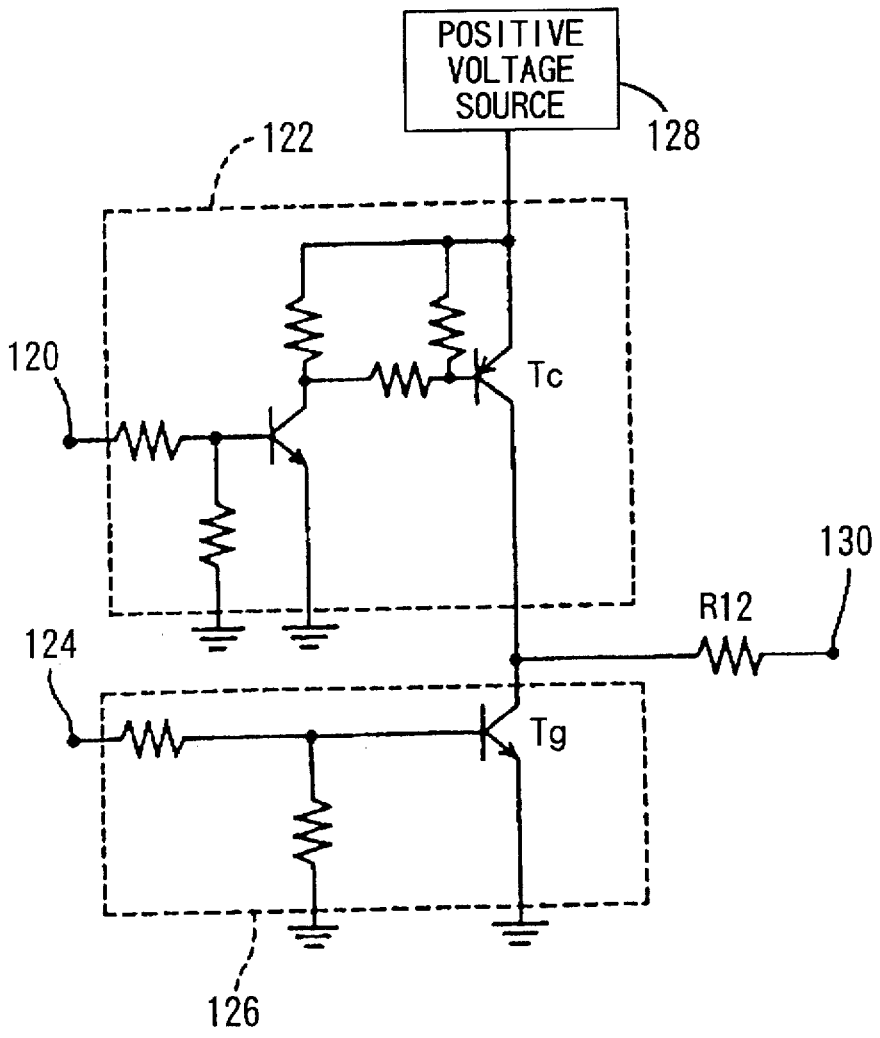
FIG. 24 is a circuit diagram showing a drive circuit which can be used in another embodiment of the present invention.

Any configuration for the control circuit 100 is acceptable so long as it generates a voltage for deforming the partition walls 6 of ink chambers 4 when ink is to be ejected. For example, the circuit shown in FIG. 24 can be used as a drive circuit 108.

The drive circuit 108 includes an ejection voltage generation circuit 122, which has an input terminal 120; and a discharge circuit 126, which has an input terminal 124. With this configuration, when an HIGH level signal is inputted to only the input terminal 120, a voltage from the power source 128 is applied to the output terminal 130. On Also, when a HIGH level signal inputted to only the input terminal 124, the output terminal 130 is connected to ground so that its voltage becomes zero.

Even with other configurations, a skilled artisan could make various changes and modifications based on his or her knowledge without departing from the spirit of the invention.

What is claimed is:

1. A method of driving an ink ejection device that includes: a piezoelectric element polarized in a direction, a plurality of partition walls being formed at equi-interval in said piezoelectric element, each of said plurality of partition walls extending in the direction in which said piezoelectric element is polarized, and having two side surfaces opposite to each other and a top surface, a plurality of grooves being formed in said piezoelectric element wherein each of said plurality of grooves is defined by adjacent two partition walls; a plurality of electrode pairs, two electrodes of each of said plurality of electrode pairs being connected together and provided on inner side surfaces of said adjacent two partition walls defining each of said plurality of grooves, respectively; a nozzle plate attached to one end of the piezoelectric element; a cover plate attached to the top surface of each of said plurality of partition walls, an ink channel being defined by said cover plate, and said adjacent two partition walls, said ink channel having a length that extends in a direction in which said plurality of partition walls extend toward said nozzle plate, said ink channel being filled with a volume of ink; and a driving device for applying a voltage to selected electrode pairs so that partition walls corresponding to the selected electrode pairs deform, the method comprising the steps of:

(a) applying the voltage to an electrode pair of a first ink chamber having a corresponding nozzle for a first duration of time to deform corresponding adjacent two partition walls of the first ink chamber in directions that are opposite to each other, thereby ejecting an ink droplet from the corresponding nozzle; and (b) after execution of step (a), applying the voltage to electrode pairs of second and third ink chambers adjacent in position to said first ink chamber for a second duration of time to deform the corresponding adjacent two partition walls in directions opposite from the directions the partition walls of said first ink chamber deformed in step (a) so that residual pressure fluctuations in the first ink chamber resulting from step (a) are canceled.

2. The method according to claim 1, wherein the first predetermined duration of time is in a range from 0.5 T to 1.5 T, and the second predetermined duration of time is in a range from 2 T to 2.25 T where T is a time required for a pressure wave imparted to the ink filled in said first chamber to propagate in a length of the ink channel of said first chamber.

3. The method according to claim 1, wherein the first predetermined duration of time is determined by a time required for a pressure wave imparted to the ink filled in said first chamber to propagate in a length of the ink channel of said first chamber, and wherein the second predetermined duration of time is twice the first predetermined duration of time.

4. The method according to claim 1, wherein a time between an end of application of voltage in step (a) and a start of application of voltage in step (b) is in a range from 0 to 0.5 T where T is a time required for a pressure wave imparted to the ink filled in said first chamber to propagate in a length of the ink channel of said first chamber.

5. A method of driving an ink ejection device that includes a piezoelectric element polarized in a direction, a plurality of partition walls being formed at equi-interval in said piezoelectric element, each of said plurality of partition walls having two side surfaces opposite to each other and a top surface, a plurality of grooves being formed in said piezoelectric element wherein each of said plurality of grooves is defined by adjacent two partition walls; a plurality of electrode pairs, two electrodes of each of said plurality of electrode pairs being connected together and provided at inner surfaces of said adjacent two partition walls defining each of said plurality of grooves, respectively; a nozzle plate attached to one end of the piezoelectric element; a cover plate attached to the top surface of each of said plurality of partition walls, an ink channel being defined by said cover plate, and said adjacent two partition walls, said ink channel having a length that extends in a direction in which said plurality of partition walls extend toward said nozzle plate, said ink channel being filled with a volume of ink; and a driving device for applying a voltage to selected electrode pairs so that partition walls corresponding to the selected electrode pairs deform, the method comprising the steps of:

(a) applying the voltage to an electrode pair of a first ink chamber so that partition walls defining said first ink chamber deform in directions that are opposite to each other, thereby increasing an internal volume of said first ink chamber from an initial volume to an increased volume;

(b) stopping application of the voltage to the electrode pair of said first ink chamber after elapse of a first predetermined duration of time from a time when the step (a) is executed so that the internal volume of said first ink chamber reverts from the increased volume to the initial volume;

(c) applying the voltage to electrode pairs of second and third ink chambers adjacent to said first ink chamber, so that the partition walls of said first ink chamber deform in directions opposite from the directions the partition walls thereof deformed in step (a) so that the internal volume of said first ink chamber decreases from the initial volume to a decreased volume; and (d) stopping application of voltage to the electrode pairs of said second and third ink chambers after elapse of a second predetermined duration of time from a time when the step (c) is executed so that the internal volume of said first ink chamber reverts from the decreased volume to the initial volume.

6. The method according to claim 5, wherein the first predetermined duration of time is in a range from 0.5 T to 1.5 T, and the second predetermined duration of time is in a range from 2 T to 2.25 T, where T is a time required for a pressure wave imparted to the ink filled in said first chamber to propagate in a length of the ink channel of said first chamber.

7. The method according to claim 5, wherein the first predetermined duration of time is determined by a time required for a pressure wave imparted to the ink filled in said first chamber to propagate in a length of the ink channel of said first chamber, and wherein the second predetermined duration of time is twice the first predetermined duration of time.

8. The method according to claim 5, wherein said step (b) and said step (c) are executed in succession.

9. The method according to claim 5, wherein the step (c) is executed after an elapse of a third predetermined duration of time from execution of the step (b).

10. The method according to claim 9, wherein a time between said step (b) and said step (c) is in a range from 0 to 0.5 T where T is a time required for a pressure wave imparted to the ink filled in said first chamber to propagate in the length of the ink channel of said first chamber.

11. The method according to claim 5, wherein voltage applied to the electrode pair of said first ink chamber in step (a) is same as the voltages applied to each of the electrode pairs of said second and third ink chambers.

12. The method according to claim 1, wherein step (b) causes residual pressure fluctuations in the first ink chamber as well as second ink chamber and third ink chamber resulting from step (a) to cancel.

13. The method according to claim 5, wherein steps (c) and (d) cause residual pressure fluctuations in the first ink chamber as well as second ink chamber and third ink chamber resulting from steps (a) and (b) to cancel.

* * * * *